US008841979B2

(12) United States Patent
Uchida

(10) Patent No.: US 8,841,979 B2
(45) Date of Patent: Sep. 23, 2014

(54) RELAY

(75) Inventor: Akikazu Uchida, Obu (JP)

(73) Assignee: Anden Co., Ltd., Anjo (JP)

( * ) Notice: Subject to any disclaimer, the term of this patent is extended or adjusted under 35 U.S.C. 154(b) by 0 days.

(21) Appl. No.: 13/547,097

(22) Filed: Jul. 12, 2012

(65) Prior Publication Data

US 2013/0021121 A1 Jan. 24, 2013

(30) Foreign Application Priority Data

Jul. 18, 2011 (JP) ..... 2011-157315
Jun. 20, 2012 (JP) ..... 2012-138539

(51) Int. Cl.

| | |
|---|---|
| ***H01H 3/00*** | (2006.01) |
| ***H01H 53/00*** | (2006.01) |
| ***H01H 50/54*** | (2006.01) |
| ***H01H 53/02*** | (2006.01) |
| ***H01H 1/54*** | (2006.01) |
| ***H01H 51/06*** | (2006.01) |
| *H01H 9/44* | (2006.01) |

(52) U.S. Cl.

CPC ..... *H01H 53/02* (2013.01); *H01H 50/546* (2013.01); *H01H 9/443* (2013.01); *H01H 1/54* (2013.01); *H01H 51/065* (2013.01)

USPC ..... 335/195; 335/131; 335/147

(58) Field of Classification Search

CPC ..... H01H 77/10

USPC ..... 335/131, 147, 195

See application file for complete search history.

(56) References Cited

U.S. PATENT DOCUMENTS

| | | | | |
|---|---|---|---|---|
| 4,467,301 | A * | 8/1984 | Goodrich | 335/195 |
| 5,030,804 | A * | 7/1991 | Abri | 200/323 |
| 5,546,061 | A | 8/1996 | Okabayashi et al. | |
| 7,902,948 | B2 * | 3/2011 | Luders | 335/201 |
| 7,948,339 | B2 * | 5/2011 | Burger et al. | 335/131 |
| 8,344,832 | B2 * | 1/2013 | Lee | 335/126 |
| 8,373,523 | B2 * | 2/2013 | Valdemarsson | 335/16 |
| 8,570,125 | B2 * | 10/2013 | Suzuki et al. | 335/185 |
| 2008/0012665 | A1 * | 1/2008 | DeBoer et al. | 335/16 |
| 2009/0096558 | A1 * | 4/2009 | Lange et al. | 335/131 |
| 2011/0080240 | A1 * | 4/2011 | Patino et al. | 335/229 |
| 2011/0241809 | A1 | 10/2011 | Sugisawa et al. | |
| 2013/0021122 | A1 * | 1/2013 | Uchida | 335/131 |

FOREIGN PATENT DOCUMENTS

| | | |
|---|---|---|
| JP | A-49-111772 | 9/1974 |
| WO | WO 2012/014369 A1 | 2/2012 |

OTHER PUBLICATIONS

U.S. Appl. No. 13/547,116, filed Jul. 12, 2012, Uchida.

* cited by examiner

*Primary Examiner* — Mohamad Musleh
(74) *Attorney, Agent, or Firm* — Posz Law Group, PLC

(57) ABSTRACT

A relay includes two stators each having a fixed contact, and a movable element having movable contacts. Each of the stators includes a stator proximity plate portion adjacent to the movable element, and the movable element includes a movable element proximity plate portion adjacent to the stators. A direction of current flowing in the stator proximity plate portions is set to be same as a direction of current flowing in the movable element proximity plate portion to generate an inter-plate attraction force for attracting the movable element proximity plate portion onto the stator proximity plate portions. The movable element proximity plate portion is biased by the inter-plate attraction force toward a direction for bringing the movable contacts into contact with the fixed contacts.

7 Claims, 20 Drawing Sheets

RELAY

CROSS REFERENCE TO RELATED APPLICATIONS

The present application is based on and claims priority to Japanese Patent Application No. 2011-157315 filed on Jul. 18, 2011, and No. 2012-138539 filed on Jun. 20, 2012, the contents of which are incorporated in their entirety herein by reference.

TECHNICAL FIELD

The present disclosure relates to a relay for opening and closing an electric circuit.

BACKGROUND

In a conventional relay, stators having fixed contacts are positioned, and a movable element having movable contacts is moved. An electric circuit is closed by bringing the movable contacts into contact with the fixed contacts. The electric circuit is opened by separating the movable contacts from the fixed contacts. More specifically, the conventional relay includes a movable member attracted by an electromagnetic force of a coil, a contact pressure spring for biasing the movable element in a direction for bringing the movable contacts into contact with the fixed contacts, and a return spring for biasing the movable element through the movable member in a direction for separating the movable contacts from the fixed contacts.

If the coil is energized, the movable member is driven in a direction for separating from the movable element by the electromagnetic force. The movable element is biased by the contact pressure spring to move so that movable contacts come into contact with the fixed contacts. Then, the movable member separates from the movable element (see, for example, Japanese Patent No. 3,321,963).

SUMMARY

It is an object of the present disclosure to provide a relay that can restrict separation between movable contacts and fixed contacts due to a contact portion electromagnetic repulsive force.

A relay according to a first aspect of the present disclosure includes two stators and a movable element. Each of the stators has a plate shape and has a fixed contact. The movable element has a plate shape and has movable contacts. The movable element is movable so that the movable contacts respectively come in contact with the fixed contacts to close an electric circuit and the movable contacts separates from the fixed contacts to open the electric circuit. Each of the stators includes a stator proximity plate portion adjacent to the movable element, and the movable element includes a movable element proximity plate portion adjacent to the stators. A direction of current flowing in the stator proximity plate portions is set to be same as a direction of current flowing in the movable element proximity plate portion to generate an inter-plate attraction force for attracting the movable element proximity plate portion onto the stator proximity plate portions. The movable element proximity plate portion is biased by the inter-plate attraction force toward a direction for bringing the movable contacts into contact with the fixed contacts.

The relay according to the first aspect can restrict separation between the movable contacts and the fixed contacts even during a large-current energization.

A relay according to a second aspect of the present disclosure includes two stators and a movable element. Each of the stators has a plate shape and has a fixed contact. The movable element has a plate shape and has movable contacts. The movable element is configured to move so that the movable contacts respectively come in contact with the fixed contacts to close an electric circuit and the movable contacts separates from the fixed contacts to open the electric circuit. Each of the stators includes a stator proximity plate portion adjacent to the movable element, and the movable element includes a movable element proximity plate portion adjacent to the stators. A direction of current flowing in one of the stator proximity plate portions is set to be opposite to a direction of current flowing in the movable element proximity plate portion to generate an inter-plate repulsive force acting in a direction for separating the movable element proximity plate portion from the stator proximity plate portions. The movable element proximity plate portion is biased by the inter-plate repulsive force toward a direction for bringing the movable contacts into contact with the fixed contacts.

Also the relay according to the second aspect can restrict separation between the movable contacts and the fixed contacts even during a large-current energization.

BRIEF DESCRIPTION OF THE DRAWINGS

Additional objects and advantages of the present disclosure will be more readily apparent from the following detailed description when taken together with the accompanying drawings. In the drawings.

DETAILED DESCRIPTION

Figure 1:
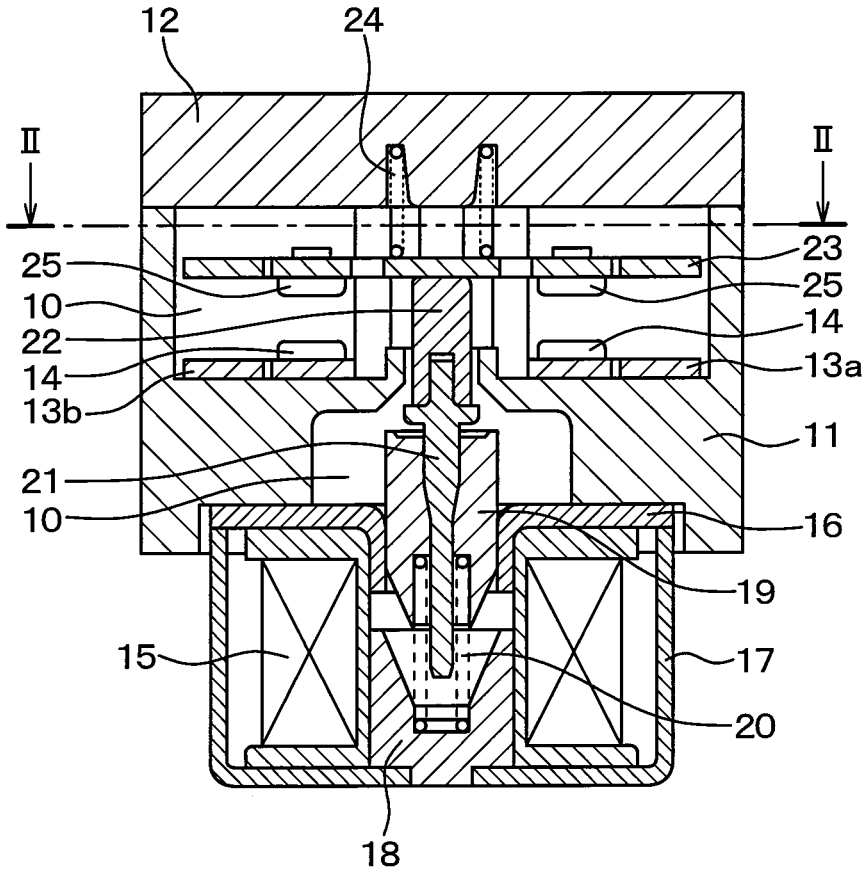
FIG. 1 is a cross-sectional view showing a relay according to a first embodiment of the present disclosure.

Before describing embodiments of the present disclosure, difficulties which the inventor of the present application found will be described below.

In a conventional relay, in contact portions of movable contacts and fixed contacts, a current inversely flows in regions where the movable contacts and the fixed contacts face each other. Accordingly, an electromagnetic repulsive force (hereinafter referred to as "contact portion electromagnetic repulsive force") is generated. The contact portion electromagnetic repulsive force acts to separate the movable contacts and the fixed contacts. Therefore, an elastic force of a contact pressure spring is set to restrict the separation between the movable contacts and the fixed contacts due to the electromagnetic repulsive force.

However, because the contact portion electromagnetic repulsive force increases with increase in the amount of current, the spring force of the contact pressure spring increases with increase in current value. Accordingly, a physical size of the contact pressure spring is increased, and furthermore a physical size of the relay is increased.

JP-A-2011-228245 (corresponding to US 2011/0241809 A1) discloses a relay in which separation between movable contacts and fixed contacts is restricted by a Lorentz force acting in a direction opposite to a contact portion electromagnetic repulsive force. Specifically, a magnet is disposed adjacent to the movable element, and the movable element is subject to the Lorentz force acting in the direction opposite to the contact portion electromagnetic repulsive force with the use of a current flowing into the movable element and a magnetic flux generated in the magnet.

The Lorentz force generated by the current and the magnetic flux is proportional to the current value and a magnetic flux density. However, in the above-described relay, because the contact portion electromagnetic repulsive force is proportional to a square of the current value, the movable contacts and the fixed contacts may separate from each other during large-current energization.

Hereinafter, embodiments of the present disclosure will be described with reference to the accompanying drawings. In the following respective embodiments, identical or equivalent portions are denoted by the same reference numerals or symbols.

First Embodiment

Figure 2:
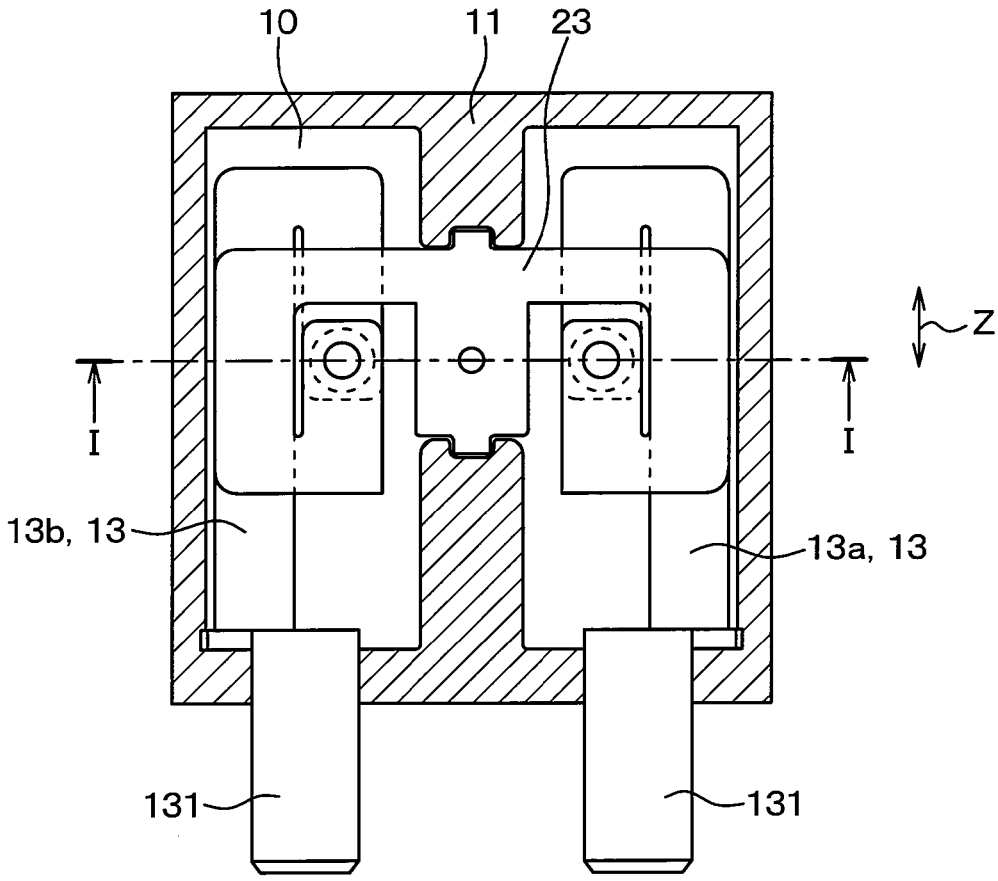
FIG. 2 is a cross-sectional view showing the relay taken along a line II-II in FIG. 1.
Figure 3A:
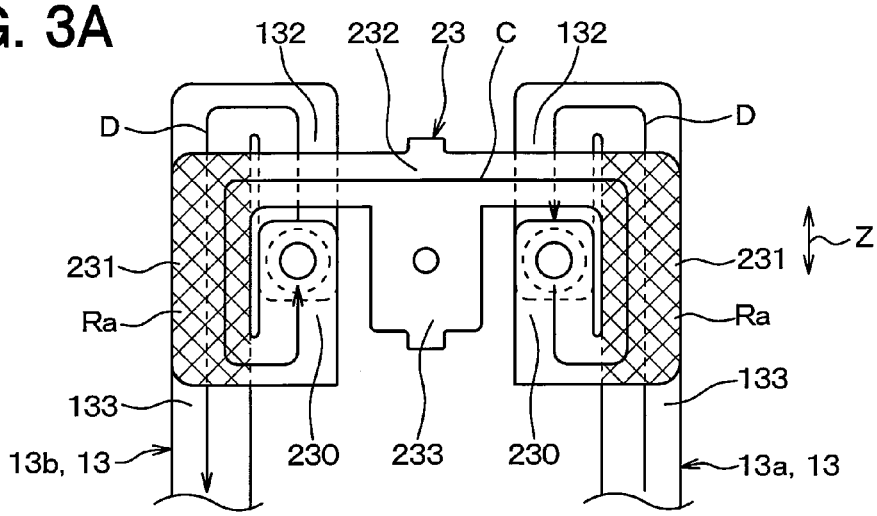
FIG. 3A is a plan view of a movable element and stators in the relay according to the first embodiment.
Figure 3B:
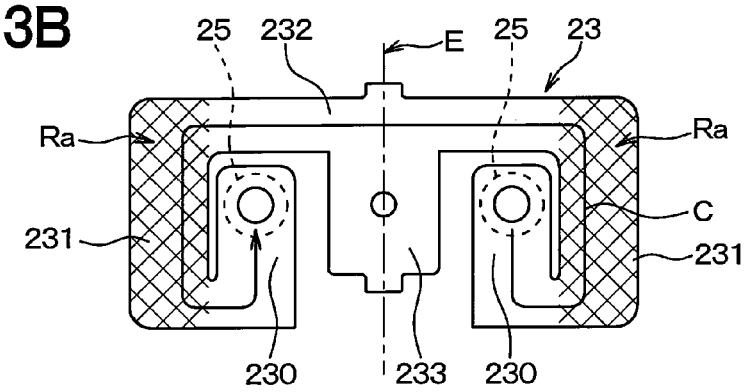
FIG. 3B is a plan view of the movable element in FIG. 3A.
Figure 3C:
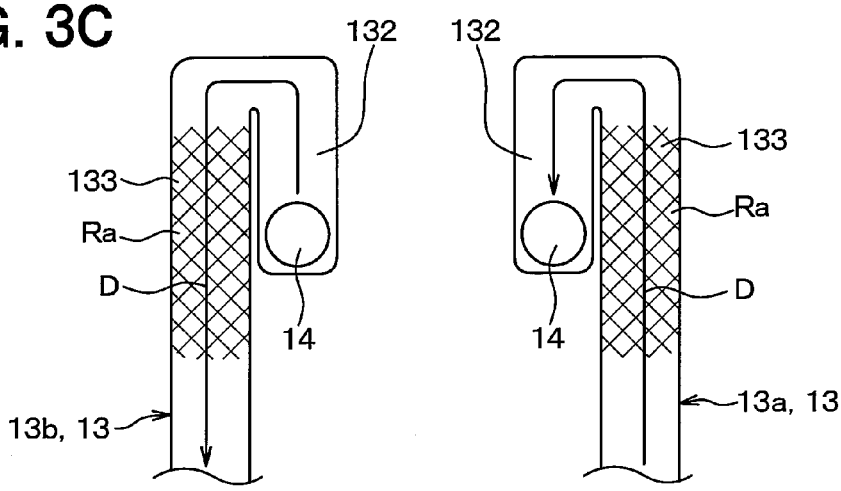
FIG. 3C is a plan view of the stators in FIG. 3A.

FIG. 1 is a cross-sectional view showing a relay according to a first embodiment of the present disclosure, which corresponds to a cross-sectional view of the relay taken along a line I-I in FIG. 2. FIG. 2 is a cross-sectional view of the relay taken along a line II-II in FIG. 1. FIG. 3A is a plan view of a movable element 23 and stators 13 in FIG. 1, FIG. 3B is a plan view of the movable element 23 in FIG. 3A, and FIG. 3C is a plan view of the stators 13 in FIG. 3A.

As shown in FIG. 1 and FIG. 2, the relay according to the present embodiment includes a base 11 and a cover 12. The base 11 is made of resin. The base 11 has an approximately rectangular parallel piped shape and defines a housing space 10 therein. The cover 12 is made of resin and is coupled to the base 11 so as to close an opening portion of the housing space 10 at one end of the base 11.

The base 11 is fixed with two stators 13. Each of the stators 13 has a plate shape and is made of an electrically conductive metal. Each of the stators 13 has one end portion located within the housing space 10, and the other end portion protruding toward an external space. In the following description, one of the stators 13 is called "first stator 13*a*" and the other is called "second stator 13*b*."

At one end portion of each stator 13 adjacent to the housing space 10, fixed contacts 14 made of an electrically conductive metal are fixed by swaging. Each of the stators 13 are formed with a load circuit terminal 131 coupled to an external harness (not shown). The load circuit terminal 131 of the first stator 13*a* is coupled to a power supply (not shown) through the external harness, and the load circuit terminal 131 of the second stator 13*b* is coupled to an electric load (not shown) through an external harness.

A cylindrical coil 15 that generates an electromagnetic force during energization is coupled to the base 11 so as to cover an opening portion of the housing space 10 at the other end of the base 11. The coil 15 is coupled to an electronic control unit (ECU), which is not shown, through the external harness, and the coil 15 is energized through the external harness.

A flanged cylindrical plate 16 made of a magnetic metal material is arranged between the base 11 and the coil 15, and a yoke 17 made of a magnetic metal material is disposed on a side of the coil 15 opposite to the base 11 and an outer peripheral side of the coil 15. The plate 16 and the yoke 17 are fixed to the base 11.

A fixed core 18 made of a magnetic metal material is arranged in an inner peripheral space of the coil 15, and the fixed core 18 is held by the yoke 17.

A movable core 19 made of a magnetic metal is arranged at a position opposite to the fixed core 18 in the inner peripheral space of the coil 15. The movable core 19 is slidably held by the plate 16.

A return spring 20 that biases the movable core 19 toward an opposite side from the fixed core 18 is arranged between the fixed core 18 and the movable core 19. During the coil energization, the movable core 19 is attracted toward the fixed core 18 against the return spring 20.

The plate 16, the yoke 17, the fixed core 18, and the movable core 19 configure a magnetic path of the magnetic flux induced by the coil 15.

A shaft 21 made of metal penetrates the movable core 19 and is fixed to the movable core 19. One end of the shaft 21 extends toward the opposite side from the fixed core 18, and the end of the shaft 21 is fitted into an insulating glass 22 made of resin which provides excellent electrical insulation. The movable core 19, the shaft 21, and the insulating glass 22 configure a movable member of the present disclosure.

A movable element 23 formed of an electrically conductive metal plate is disposed in the housing space 10. A contact pressure spring 24 that biases the movable element 23 toward the stators 13 is disposed between the movable element 23 and the cover 12.

Movable contacts 25 made of an electrically conductive metal are fixed by swaging on the movable element 23 at respective positions facing the fixed contacts 14. When the movable core 19 is driven toward the fixed core 18 by an electromagnetic force, the fixed contacts 14 and the movable contacts 25 come in contact with each other.

The detailed configuration and arrangement of the stators 13 and the movable element 23 will be described below with reference to FIG. 1 to FIG. 3C.

An arrow C in FIG. 3A to FIG. 3C represents a flow of current in the movable element 23, and an arrow D in FIG. 3A to FIG. 3C represents a flow of current in the stators 13. In the present specification, an alignment direction of the two movable contacts 25 (right and left directions on a paper plane in FIG. 1 to FIG. 3C) is called "movable contact alignment direction." A moving direction of the movable element 23 (up and down directions on the paper plane in FIG. 1, and vertical direction on the paper plane in FIG. 2 and FIG. 3A to FIG. 3C) is called "movable element moving direction." A direction perpendicular to both of the movable contact alignment direction and the movable element moving direction (vertical direction on the paper plane in FIG. 2 and FIG. 3A to FIG. 3C) is called "reference direction Z."

The movable element 23 includes two movable contact mounting plates 230 on which the respective movable contacts 25 are fixed, and two movable element outside plates 231 located outside of the movable contact mounting plates 230 in the movable contact alignment direction.

The movable contact mounting plates 230 and the movable element outside plates 231 extend in parallel to the reference direction Z, and are coupled to each other on one end side in the extending direction. Also, the other end sides of the two movable element outside plates 231 in the extending direction are coupled to one movable element coupling plate 232. The movable element coupling plate 232 extend in the movable contact alignment direction.

The movable element 23 includes one spring bearing plate 233 that bears the contact pressure spring 24. The spring bearing plate 233 is located between the two movable contact mounting plates 230, protrudes from an intermediate portion of the movable element coupling plate 232 in a longitudinal direction thereof, and extends in the reference direction Z.

A shape of the movable element 23 in a planar view is linearly symmetric with respect to a line E as shown in FIG. 3B.

Each of the stators 13 includes a fixed contact mounting plate 132 on which the fixed contact 14 is fixed, and a stator outside plate 133 located outside of the fixed contact mounting plate 132 in the movable contact alignment direction.

Each fixed contact mounting plate 132 and each stator outside plate 133 extend in parallel to the reference direction Z, and are coupled to each other on one end side in the extending direction.

When viewed along the movable element moving direction, the whole area of the movable element outside plates 231 overlaps with a part of the stator outside plates 133, and the overlap regions of the respective plates are disposed adjacent to each other. Hereinafter, the overlap and adjacent regions are called "proximity regions Ra.". In FIG. 3A to FIG. 3C, the proximity regions Ra are indicated by mesh designs for descriptive purposes.

In the proximity regions Ra, the shapes and arrangements of the stators 13 and the movable element 23 are set so that a direction of current flowing in the movable element 23 is the same as a direction of current flowing in the stators 13.

The regions of the movable element 23 configuring the proximity regions Ra, that is, the movable element outside plates 231 correspond to movable element proximity plate portions. Also, the regions of the stators 13 configuring the proximity regions Ra, that is, the regions of the stator outside plates 133, which overlap with the movable element outside plates 231 in the movable element moving direction, correspond to stator proximity plate portions.

Subsequently, the operation of the relay according to the present embodiment will be described. First, when the coil 15 is energized, the movable core 19, the shaft 21, and the insulating glass 22 are attracted toward the fixed core 18 against the return spring 20 by the electromagnetic force. The movable element 23 is biased by the contact pressure spring 24, and moves while following the movable core 19. As a result, the movable contacts 25 come in contact with the opposed fixed contacts 14, and the two load circuit terminals 131 are electrically coupled to each other, and a current flows through the movable element 23. After the movable contacts 25 have come in contact with the fixed contacts 14, the movable core 19 is further moved toward the fixed core 18 so that the insulating glass 22 and the movable element 23 move away from each other.

When the two load circuit terminals 131 are electrically coupled to each other, a direction of current flowing in the movable element 23 is the same as a direction of current flowing in the stators 13 in the proximity regions Ra. Therefore, an attraction that is the Lorentz force is generated between the movable element 23 and the stators 13 in the proximity regions Ra. Hereinafter, the attraction in the proximity regions R is called "inter-plate attraction Ra."

In cases where a current pathway in the proximity region Ra is one route (that is, when the current pathway in the proximity region Ra does not diverge), the inter-plate attraction Ra can be calculated from the following equation (1).

$$\text{Inter-plate attraction } Ra=(\mu_0 \cdot i/2\cdot\pi\cdot r)\cdot L\cdot i=(\mu_0/2\cdot\pi\cdot r)\cdot L\cdot i^2 \quad (1)$$

where, "$\mu_0$" is a magnetic permeability of fluid between the movable element 23 and the stator 13, "i" is a current value of current flowing in the proximity region Ra, "r" is an opposite distance between the movable element 23 and the stator 13 in the proximity region Ra in a state where the movable contacts 25 are in contact with the fixed contacts 14, and "L" is a length of the proximity region Ra.

As is clear from the equation (1), the inter-plate attraction Ra in cases where the current pathway in the proximity region Ra is one route is proportional to the square of current value (that is, $i^2$). In contrast, in cases where the current pathway in the proximity region Ra diverges into two routes, the inter-plate attraction Ra is proportional to $\frac{1}{2}\cdot i^2$. Thus, the relay according to the present embodiment can obtain the inter-plate attraction Ra twice as much as the cases where the current pathway in the proximity region Ra diverges into two routes.

The movable element 23 is attracted to the stators 13 by the inter-plate attraction Ra. In other words, the movable element 23 is biased in a direction of bringing the movable contacts 25 into contact with the fixed contacts 14 due to the inter-plate attraction Ra. The force by which the movable element 23 is biased due to the inter-plate attraction Ra counteracts a contact portion electromagnetic repulsive force. Accordingly, separation between the movable contacts 25 and the fixed contacts 14 due to the contact portion electromagnetic repulsive force can be restricted.

On the other hand, when the energization to the coil 15 has been blocked off, the movable core 19 and the movable element 23 are biased toward the opposite side from the fixed core 18 against the contact pressure spring 24 due to the return spring 20. With this operation, the movable contacts 25 move away from the fixed contacts 14, and the two load circuit terminals 131 are decoupled from each other.

According to the present embodiment, because the inter-plate attraction Ra is proportional to the square of the current value, separation between the movable contacts 25 and the fixed contacts 14 due to the contact portion electromagnetic repulsive force can be restricted with certainty even during a large-current energization. Accordingly, the spring force of the contact pressure spring 24 can be set to be smaller, the contact pressure spring 24 can be downsized, and furthermore the relay can be downsized.

Second Embodiment

Figure 4A:
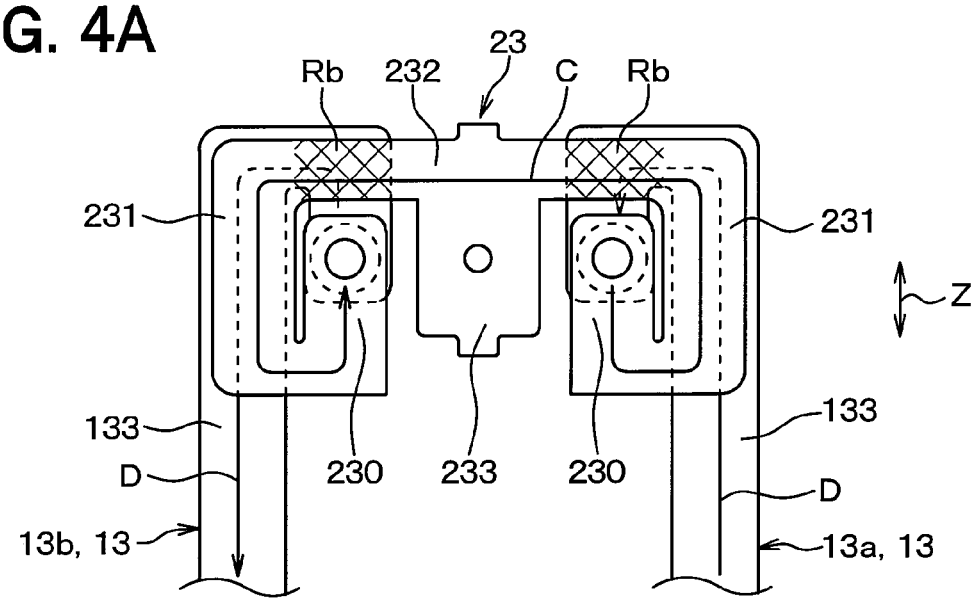
FIG. 4A is a plan view of a movable element and stators in a relay according to a second embodiment of the present disclosure.
Figure 4B:
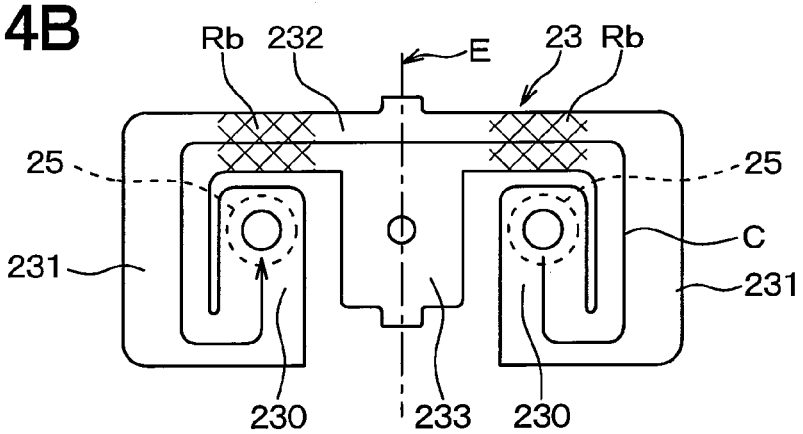
FIG. 4B is a plan view of the movable element in FIG. 4A.
Figure 4C:
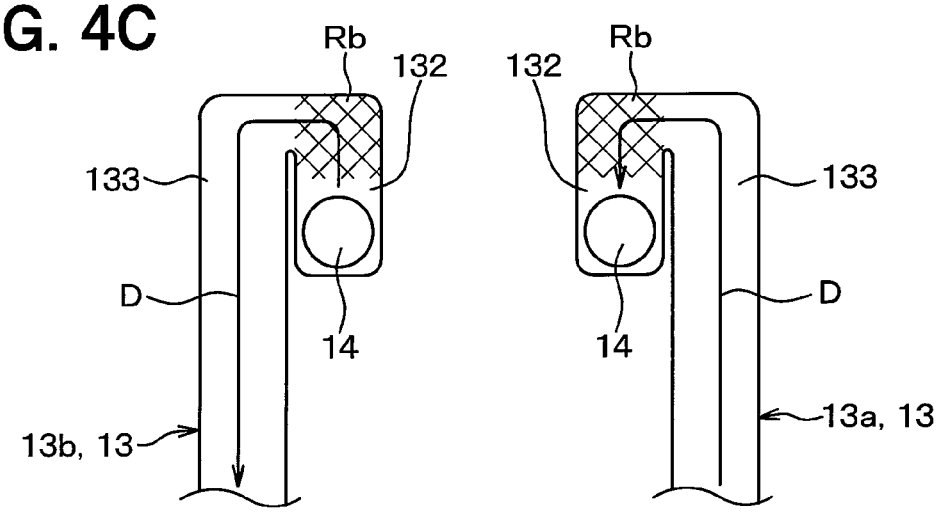
FIG. 4C is a plan view of the stators in FIG. 4A.

A second embodiment of the present disclosure will be described. FIG. 4A is a plan view showing movable element 23 and stators 13 in a relay according to the second embodiment of the present disclosure, FIG. 4B is a plan view of the movable element 23 in FIG. 4A, and FIG. 4C is a plan view of the stators 13 in FIG. 4A. Hereinafter, only portions different from those in the first embodiment will be described.

As shown in FIG. 4A to FIG. 4C, when viewed along the movable element moving direction, a part of the movable element coupling plate 232 overlaps with a part of the fixed contact mounting plates 132, and the overlap regions of the respective plates are disposed adjacent to each other. Hereinafter, the overlap and adjacent regions are called "proximity regions Rb." In FIG. 4A to FIG. 4C, the proximity regions Rb are indicated by mesh designs for descriptive purposes.

In the proximity regions Rb, the shapes and arrangements of the stators 13 and the movable element 23 are set so that a direction of current flowing in the movable element 23 is the same as a direction of current flowing in the stators 13.

The regions of the movable element 23 configuring the proximity regions Rb correspond to the movable element proximity plate portions. Also, the regions of the stators 13 configuring the proximity regions Rb correspond to the stator proximity plate portions.

In the present embodiment, a direction of current flowing in the movable element 23 is the same as a direction of current flowing in the stators 13 in the proximity regions Rb. Therefore, an attraction that is the Lorentz force is generated between the movable element 23 and the stators 13 in the proximity regions Rb. Hereinafter, the attraction in the proximity regions Rb is called "inter-plate attraction Rb."

The movable element 23 is attracted toward the stators 13 by not only the inter-plate attraction Ra but also the inter-plate attraction Rb. Accordingly, separation between the movable contacts 25 and the fixed contacts 14 due to the contact portion electromagnetic repulsive force can be further restricted.

In the present embodiment, the inter-plate attraction Rb acts on one side of each of the contact portions (hereinafter referred to as "contact contacted portions") of the fixed contacts 14 and the movable contacts 25 in the reference direction Z. Therefore, the movable element 23 is easily inclined by the inter-plate attractions Rb. Accordingly, portions of the movable element 23 and the stators 13 other than the contacts may contact each other, thereby making a current or a voltage unstable, or vibrating the movable element 23 with the occurrence of sound.

Figure 5:
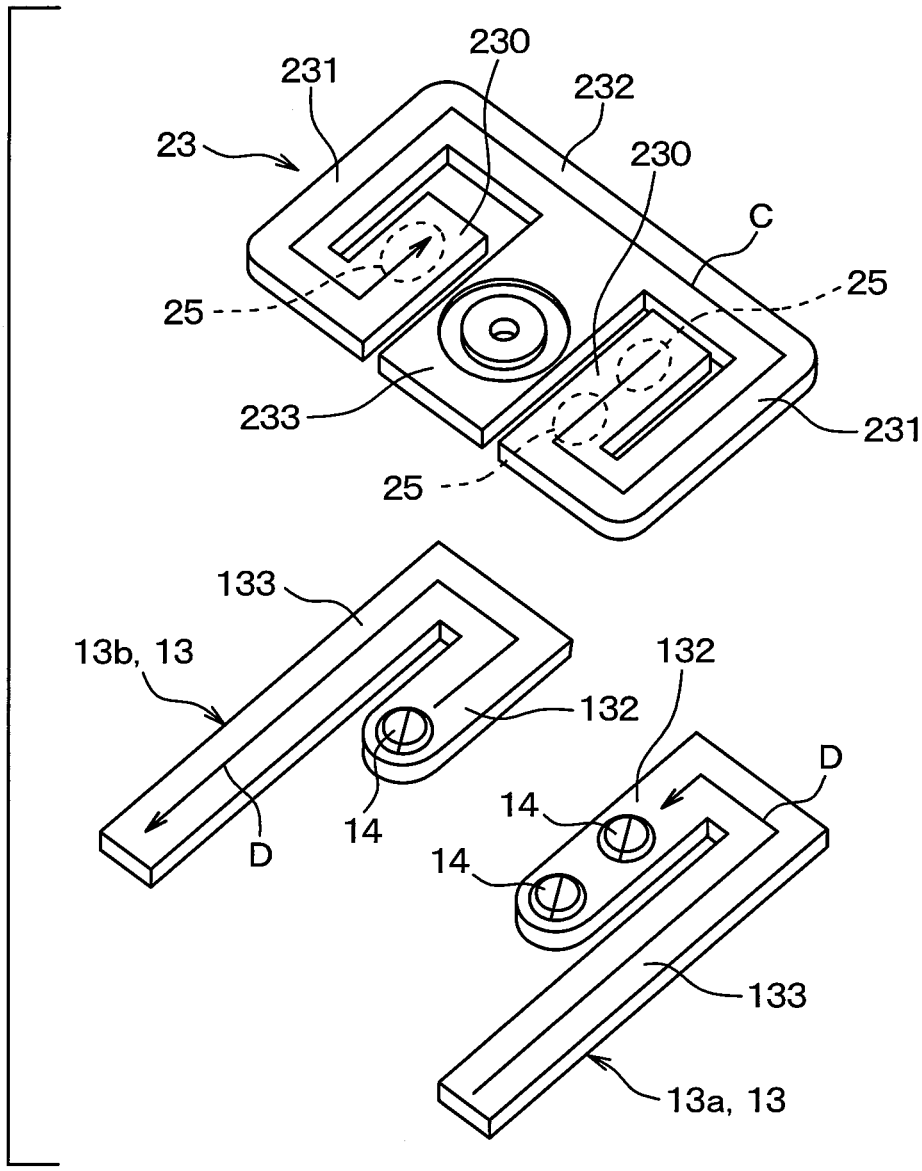
FIG. 5 is a perspective view of a movable element and stators according to a first modification of the second embodiment.

Under the circumstances, as in a first modification of the second embodiment shown in FIG. 5, three fixed contacts 14 and three movable contacts 25 may be provided, and the fixed contacts 14 and the movable contacts 25 may be arranged so that a line connecting the three fixed contacts 14 and a line connecting the three movable contacts 25 each form a triangle when viewed along the movable element moving direction. According to this configuration, because three contact contacted portions are provided, the movable element 23 is restricted from vibrating, and furthermore the above-described malfunction caused by vibration of the movable element 23 can be restricted.

Figure 6:
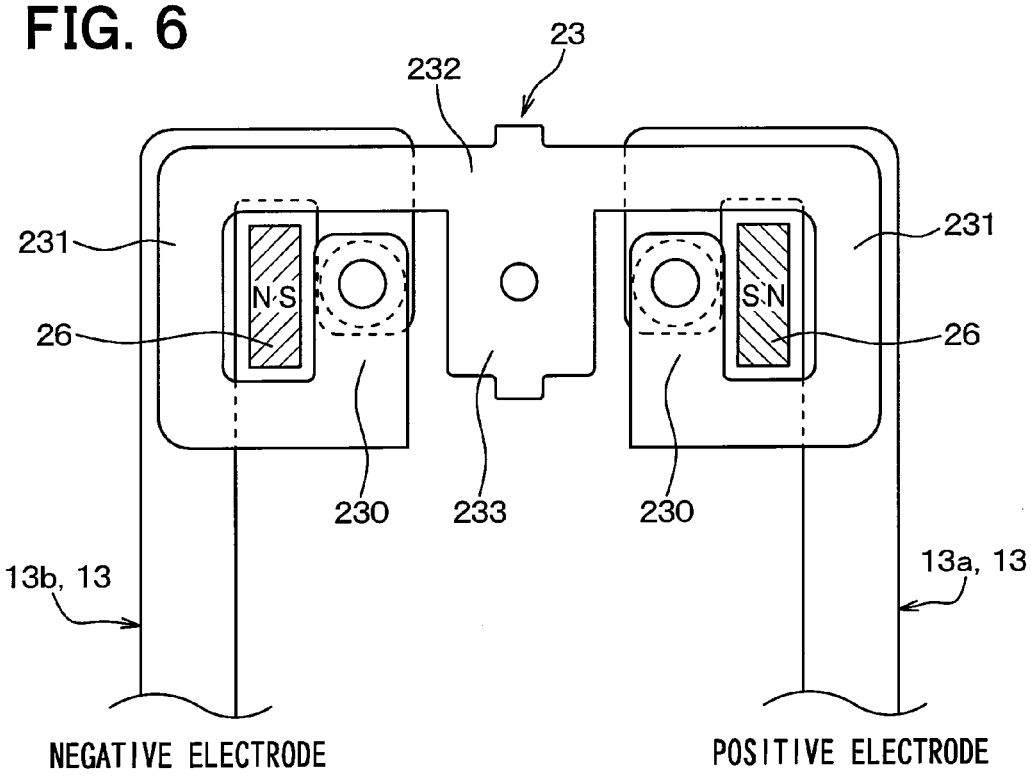
FIG. 6 is a plan view of a movable element and stators according to a second modification of the second embodiment.

Also, as in a second modification of the second embodiment shown in FIG. 6, a permanent magnet 26 for extending an arc generated when the movable contacts 25 move away from the fixed contacts 14 may be provided.

The permanent magnet 26 is arranged between the movable contact mounting plates 230 and the movable element outside plates 231. Directions of the current and the magnetic flux are set so that the Lorentz force, which acts on the movable element 23 by the current flowing in the movable element 23 and the magnetic flux of the permanent magnet 26, acts in the direction for bringing the movable contacts 25 into contact with the fixed contacts 14. Accordingly, separation between the movable contacts 25 and the fixed contacts 14 due to the contact portion electromagnetic repulsive force can be further restricted.

Figure 7:
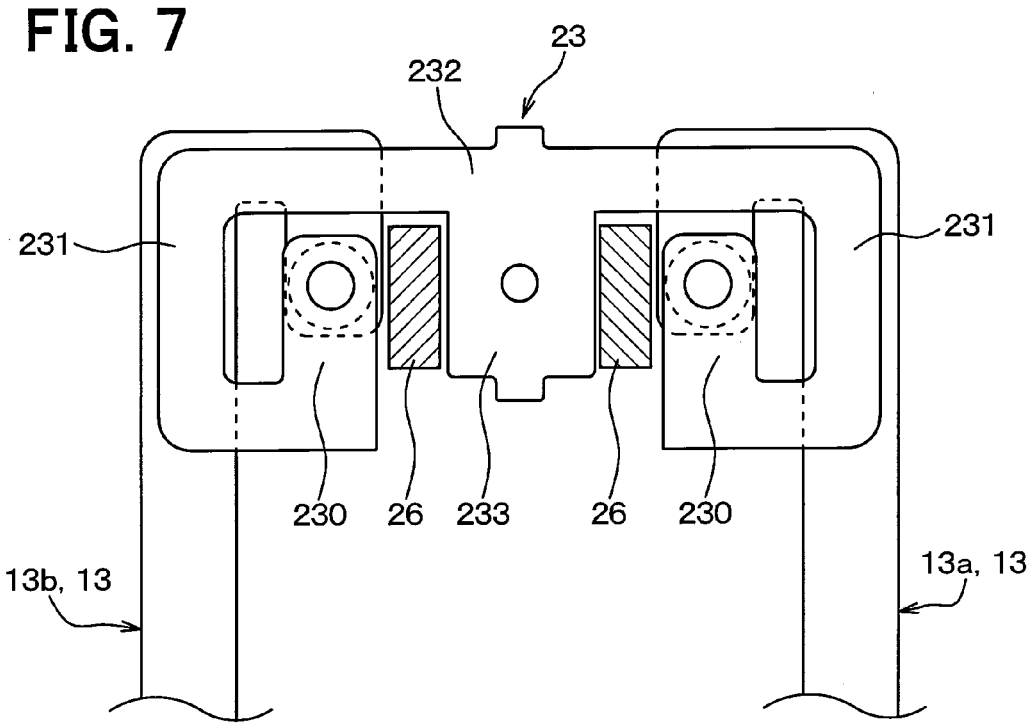
FIG. 7 is a plan view of a movable element, stators, and a magnet according to a third modification of the second embodiment.

Further, as in a third modification of the second embodiment shown in FIG. 7, the permanent magnet 26 for extending the arc generated when the movable contacts 25 move away from the fixed contacts 14 may be arranged between the movable contact mounting plates 230 and the spring bearing plate 233. In this case, the direction of the magnetic flux of the permanent magnet 26 can be freely set regardless of the direction of the current flowing in the movable element 23.

Third Embodiment

Figure 8:
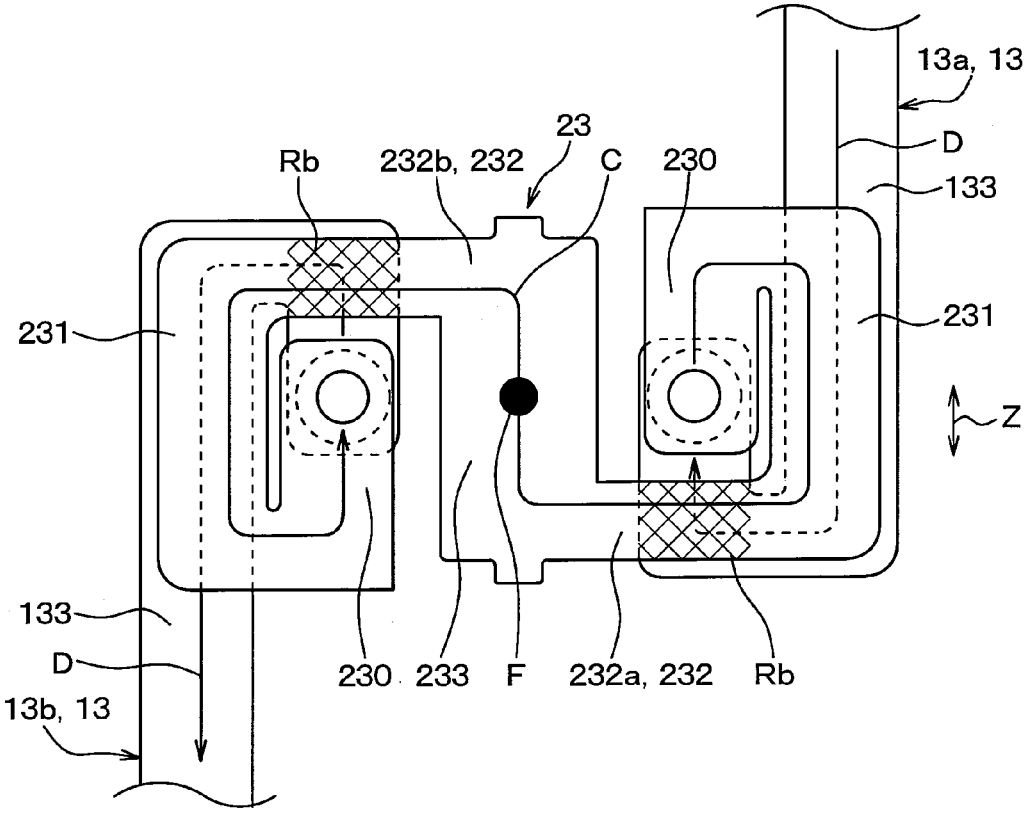
FIG. 8 is a plan view of a movable element and stators in a relay according to a third embodiment of the present disclosure.

A third embodiment of the present disclosure will be described. FIG. 8 is a plan view showing a movable element 23 and stators 13 in a relay according to the third embodiment of the present disclosure. Hereinafter, only portions different from those in the second embodiment will be described.

As shown in FIG. 8, in the present embodiment, the position of the first stator 13*a* is changed. In more detail, the load circuit terminal 131 (refer to FIG. 2) of the first stator 13*a* and the load circuit terminal 131 (refer to FIG. 2) of the second stator 13*b* protrude outside at a diagonal position of the base 11 (refer to FIG. 2).

Also, the shapes of the movable element 23 and the stators 13 are changed in correspondence with the positional change of the first stator 13*a*. As shown in FIG. 8, the shapes of the movable element 23 and the stators 13 in a planar view are changed into a point-symmetric shape with respect to a point F.

In more detail, the movable element coupling plate 232 is divided into a first movable element coupling plate 232*a* adjacent to the first stator 13*a* and a second movable element coupling plate 232*b* adjacent to the second stator 13*b*. One end sides of the first movable element coupling plate 232*a* and the second movable element coupling plate 232*b* are coupled to the movable element outside plates 231, and the other end side of the first movable element coupling plate 232*a* and the other end side of the second movable element coupling plate 232*b* are coupled to each other by the spring bearing plate 233.

When viewed along the movable element moving direction, a part of the first movable element coupling plate 232*a* and a part of second movable element coupling plate 232*b* overlap with a part of the fixed contact mounting plates 132, and the overlap regions of the respective plates are disposed adjacent to each other. In FIG. 8, the overlap and adjacent regions are called "proximity regions Rb", which are indicated by mesh designs for descriptive purposes. In the proximity regions Rb, the inter-plate attraction Rb that is the Lorentz force is generated between the movable element 23 and the stators 13.

In the present embodiment, the inter-plate attractions Rb that are the attractions of the proximity regions Rb are generated on one side of the contact contacted portions in the reference direction Z, and also on the other side of the contact contacted portions in the reference direction Z. As a result, the posture of the movable element 23 becomes stabilized.

Figure 9:
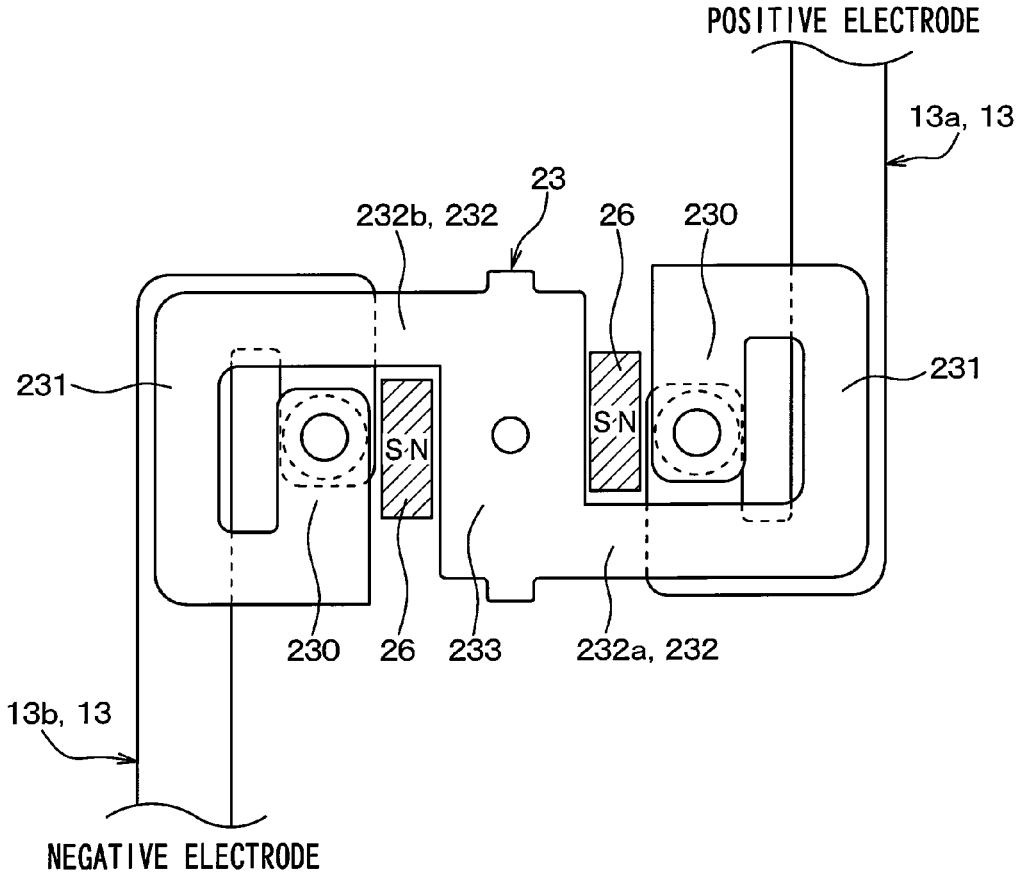
FIG. 9 is a plan view of a movable element, stators, and a magnet according to a first modification of the third embodiment.

As in a first modification of the third embodiment shown in FIG. 9, the permanent magnet 26 for extending the arc generated when the movable contacts 25 move away from the fixed contacts 14 may be provided.

The permanent magnet 26 may be arranged between the movable contact mounting plates 230 and the spring bearing plate 233. The directions of the current and the magnetic flux are set so that the Lorentz force, which acts on the movable element 23 by the current flowing in the movable element 23 and the magnetic flux of the permanent magnet 26, acts in the direction for bringing the movable contacts 25 into contact with the fixed contacts 14.

With the above configuration, separation between the movable contacts 25 and the fixed contacts 14 due to the contact portion electromagnetic repulsive force can be further restricted. Also, because a magnetic force is efficiently generated on a region where energization is concentrated, the Lorentz force, which acts on the movable element 23 by the current flowing in the movable element 23 and the magnetic flux of the permanent magnet 26, can be increased.

Fourth Embodiment

Figure 10A:
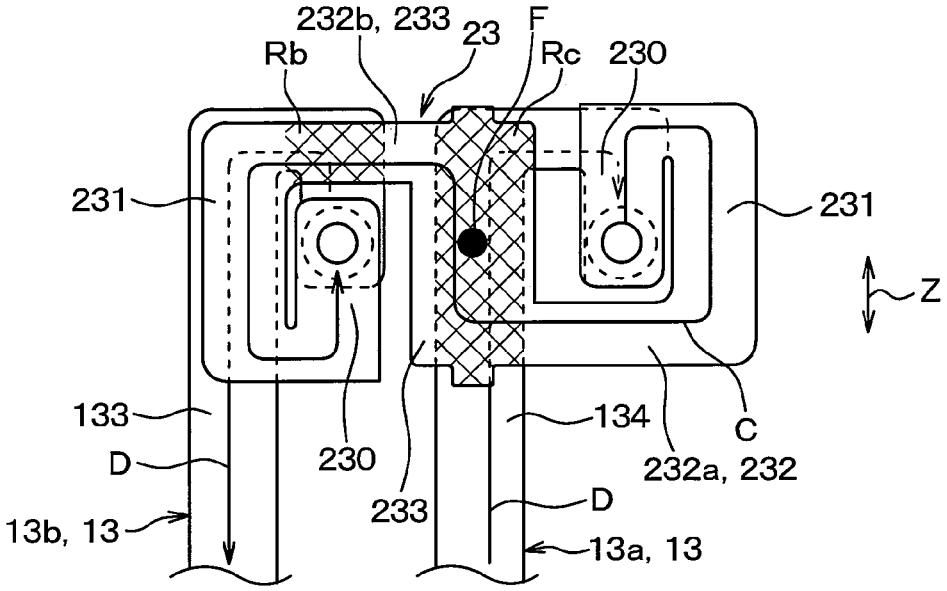
FIG. 10A is a plan view showing a movable element and stators in a relay according to a fourth embodiment of the present disclosure.
Figure 10B:
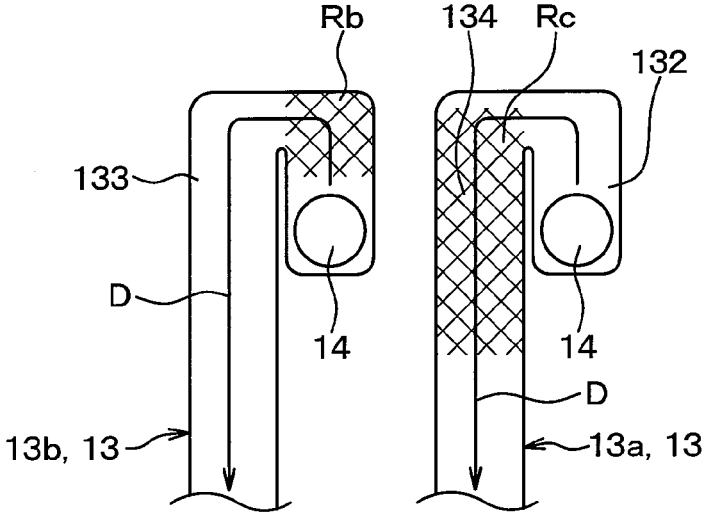
FIG. 10B is a plan view of the stators in FIG. 10A.

A fourth embodiment of the present disclosure will be described. FIG. 10A is a plan view showing a movable element 23 and stators 13 in a relay according to the fourth embodiment of the present disclosure, and FIG. 10B is a plan view of the stators 13 in FIG. 10A. Hereinafter, only portions different from those in the second embodiment will be described.

As shown in FIG. 10A and FIG. 10B, in the present embodiment, the first stator 13*a* and the second stator 13*b* have the same shape.

More particularly, the first stator 13*a* includes the fixed contact mounting plate 132 on which the fixed contact 14 is fixed, and a stator inside plate 134 located between the fixed contact mounting plates 132 and the second stator 13*b* (that is, inside of the movable contact alignment direction).

Also, the shape of the movable element 23 is changed in correspondence with the above configuration. As shown in FIG. 10A and FIG. 10B, the shape of the movable element 23 in a planar view is changed to a point-symmetric shape with respect to a point F.

More specifically, the movable element coupling plate 232 is divided into the first movable element coupling plate 232*a* adjacent to the first stator 13*a*, and the second movable element coupling plate 232*b* adjacent to the second stator 13*b*. One end sides of the first movable element coupling plate 232*a* and the second movable element coupling plate 232*b* are coupled to the movable element outside plates 231, and the other end side of the first movable element coupling plate 232*a* and the other end side of the second movable element coupling plate 232*b* are coupled to each other by the spring bearing plate 233.

When viewed along the movable element moving direction, a part of the second movable element coupling plate 232*b* overlaps with a part of the fixed contact mounting plate 132, and the overlap regions of the respective plates are disposed adjacent to each other. In FIG. 10A and FIG. 10B, the overlap and adjacent regions are called "proximity region Rb", which are indicated by mesh designs for descriptive purposes. In the proximity region Rb, the inter-plate attraction b that is the Lorentz force is generated between the movable element 23 and the stators 13.

Also, when viewed along the movable element moving direction, a part of the spring bearing plate 233 overlaps with a part of the stators inside plate 134 in the first stator 13*a*, and the overlap regions of the respective plates are disposed adjacent to each other. In FIG. 10A and FIG. 10B, the overlap and adjacent regions are called "proximity region Rc", which are indicated by mesh designs for descriptive purposes.

In the proximity region Rc, the shapes and arrangements of the stators 13 and the movable element 23 are set so that a direction of current flowing in the movable element 23 is the same as a direction of current flowing in the stators 13.

Accordingly, even in the proximity region Rc, the attraction that is the Lorentz force is generated between the movable element 23 and the stators 13.

The region of the movable element 23 configuring the proximity region Rc corresponds to the movable element proximity plate portion. Also, the region of the stators 13 configuring the proximity region Rc corresponds to the stator proximity plate portion.

In the present embodiment, because the first stator 13*a* and the second stator 13*b* have the same shape, the costs of the components of the stators can be reduced.

Fifth Embodiment

Figure 11A:
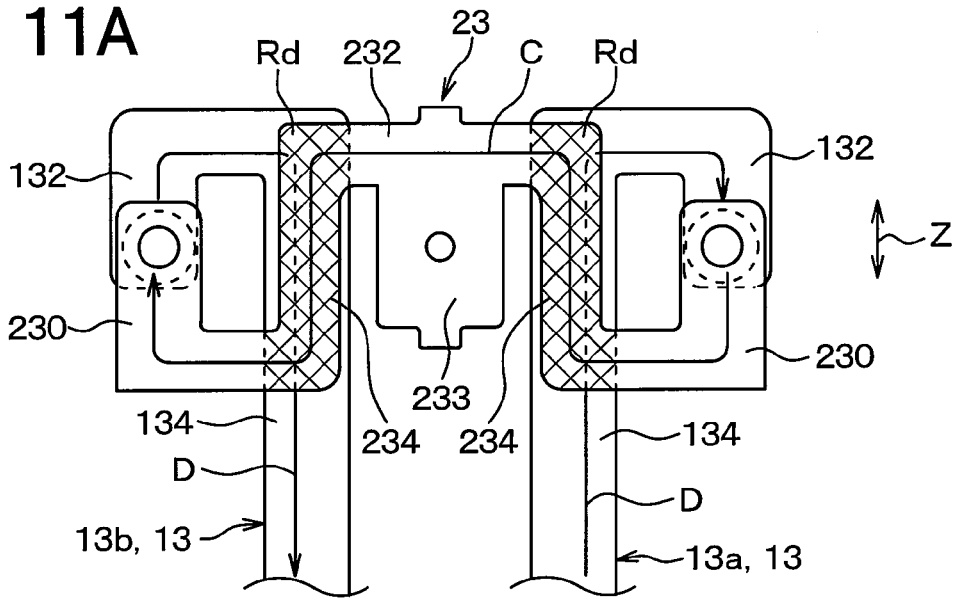
FIG. 11A is a plan view showing a movable element and stators in a relay according to a fifth embodiment of the present disclosure.
Figure 11B:
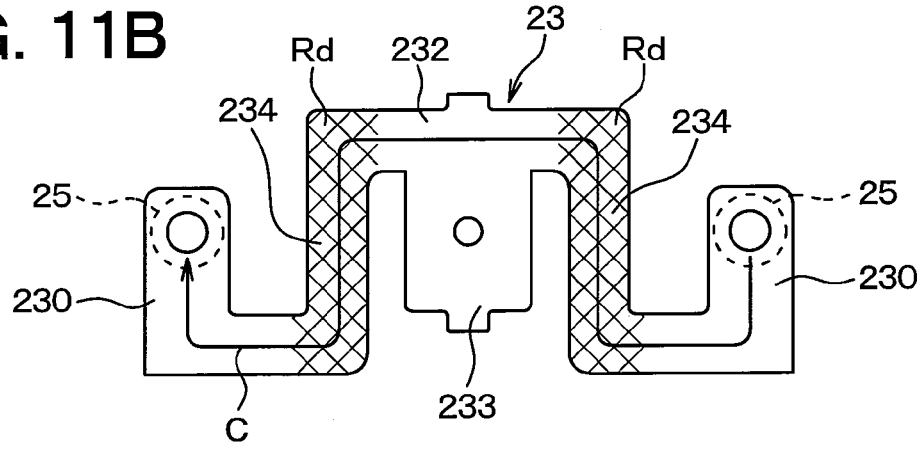
FIG. 11B is a plan view of the movable element in FIG. 11A.
Figure 11C:
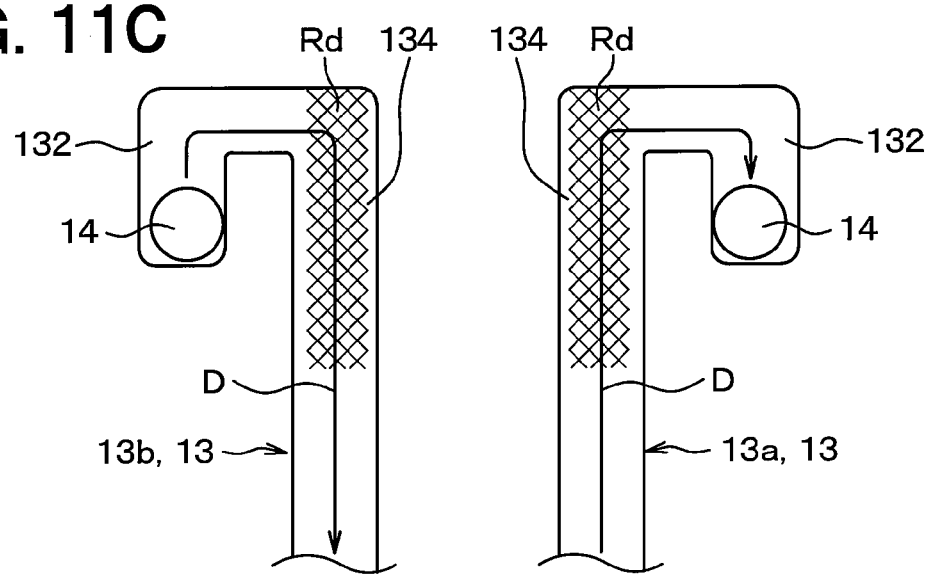
FIG. 11C is a plan view of the stators in FIG. 11A.

A fifth embodiment of the present disclosure will be described. FIG. 11A is a plan view showing a movable element 23 and a stators 13 in a relay according to the fifth embodiment of the present disclosure, FIG. 11B is a plan view of the movable element 23 in FIG. 11A, and FIG. 11C is a plan view of the stators 13 in FIG. 11A. Hereinafter, portions different from those in the second embodiment will be described.

As shown in FIG. 11A to FIG. 11C, the movable element 23 includes the two movable contact mounting plates 230 on which the respective movable contacts 25 are fixed, and two movable element inside plates 234 located inside of the movable contact mounting plates 230 in the movable contact alignment direction.

The movable contact mounting plates 230 and the movable element inside plates 234 extend in parallel to the reference direction Z, and are coupled to each other on one end sides thereof in the extending direction. Also, the other end sides of the two movable element inside plates 234 in the extending direction are coupled to each other by one movable element coupling plate 232. The movable element coupling plate 232 extends in the movable contact alignment direction.

The movable element 23 includes one spring bearing plate 233 that bears the contact pressure spring 24. The spring bearing plate 233 is located between those two movable element inside plates 234, protrudes from an intermediate portion of the movable element coupling plate 232 in the longitudinal direction thereof, and extends in the reference direction Z.

The stators 13 includes the fixed contact mounting plates 132 on which the respective fixed contacts 14 are fixed, and the stator inside plates 134 located inside of the fixed contact mounting plates 132 in the movable contact alignment direction. Each of the fixed contact mounting plates 132 and each of the stator inside plates 134 extend in parallel to the reference direction Z, and are coupled to each other on one end side thereof in the extending direction.

When viewed along the movable element moving direction, the whole area of the movable element inside plates 234 overlaps with a part of the stator inside plates 134, and the overlap regions of the respective plates are disposed adjacent to each other. Hereinafter, the overlap and adjacent regions are called "proximity regions Rd." In FIG. 11A to FIG. 11C, the proximity regions Rd are indicated by mesh designs for descriptive purposes.

The shapes and arrangements of the stators 13 and the movable element 23 are set in the proximity regions Rd so that a direction of current flowing in the movable element 23 is the same as a direction of current flowing in the stators 13. Accordingly, even in the proximity regions Rd, the attraction that is the Lorentz force is generated between the movable element 23 and the stators 13. The movable element 23 is attracted toward the stators 13 by the attraction of the proximity regions Rd. Accordingly, separation between the movable contacts 25 and the fixed contacts 14 due to the contact portion electromagnetic repulsive force can be further restricted.

The regions of the movable element 23 configuring the proximity regions Rd, that is, the movable element inside plates 234 correspond to the stator proximity plate portions. Also, the regions of the stators 13 configuring the proximity regions Rd, that is, the regions of the stator inside plates 134, which overlap with the movable element inside plates 234 in the movable element moving direction, correspond to the stator proximity plate portions.

The proximity regions Rd are disposed between the fixed contact 14 of the first stator 13*a* and the fixed contact 14 of the second stator 13*b*, and the fixed contacts 14 are located on the outermost of the respective stators 13 in the movable contact alignment direction. Also, the movable contacts 25 are located on the outermost of the respective movable element 23 in the movable contact alignment direction.

Incidentally, the contact contacted portions are likely to generate heat. On the other hand, as in the present embodiment, the fixed contacts 14 and the movable contacts 25 are arranged outermost in the movable contact alignment direction so that a distance between one contact contacted portion and the other contact contacted portion can be increased (that is, heat source is dispersed), and the contact contacted portions can be brought closer to the base 11 cooled by the external air. As a result, the heat radiation of the contact contacted portions can be efficiently conducted so that a temperature rise of the contact contacted portions can be suppressed.

Figure 12:
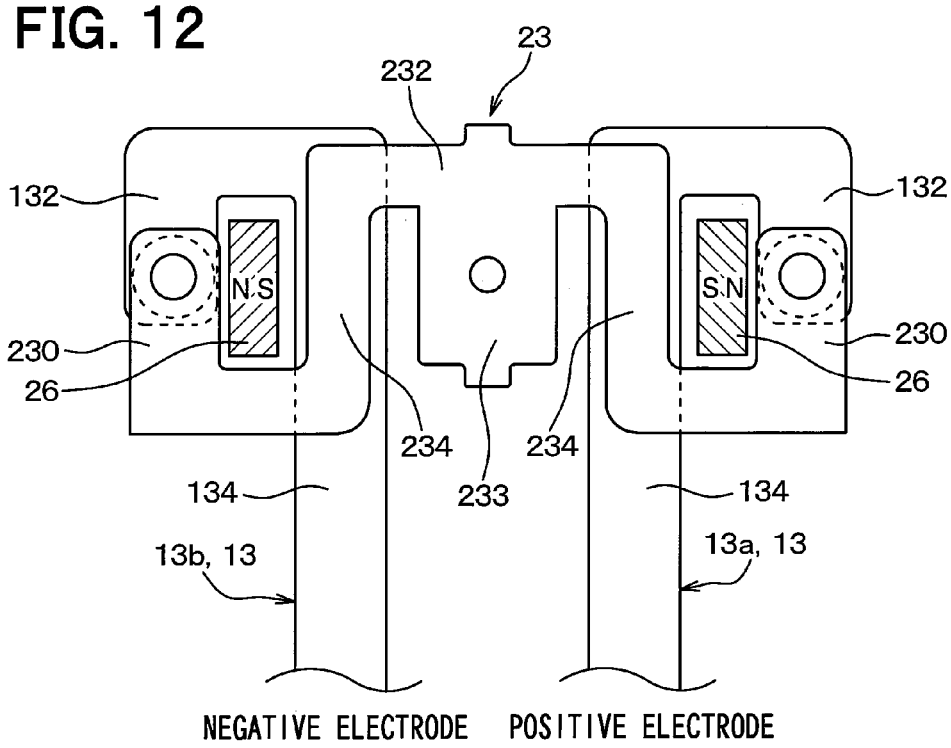
FIG. 12 is a plan view showing a movable element, stators, and a magnet according to a first modification of the fifth embodiment.

As in a first modification of the fifth embodiment shown in FIG. 12, the permanent magnet 26 for extending the arc generated when the movable contacts 25 move away from the fixed contacts 14 may be provided.

The permanent magnet 26 is arranged between the movable contact mounting plates 230 and the movable element inside plates 234. The directions of the current and the magnetic flux are set so that the Lorentz force, which acts on the movable element 23 by the current flowing in the movable element 23 and the magnetic flux of the permanent magnet 26, acts in the direction for bringing the movable contacts 25 into contact with the fixed contacts 14. With the above configuration, separation between the movable contacts 25 and the fixed contacts 14 due to the contact portion electromagnetic repulsive force can be further restricted.

Also, because the fixed contacts 14 and the movable contacts 25 are disposed outermost in the movable contact alignment direction, an arc blocking space is easily to be ensured.

Figure 13:
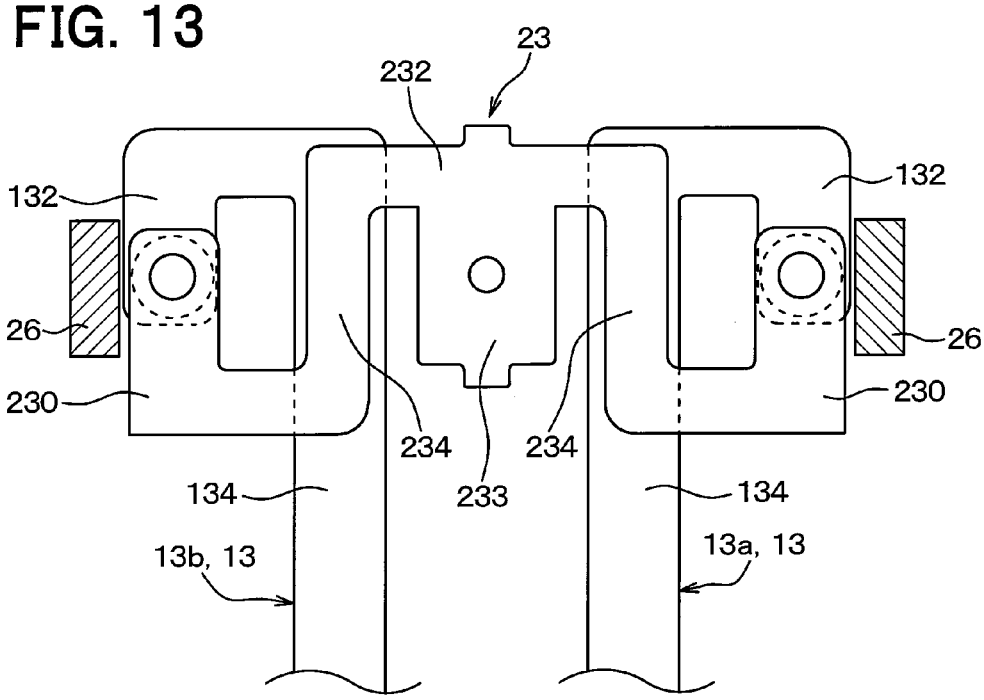
FIG. 13 is a plan view showing a movable element, stators, and a magnet according to a second modification of the fifth embodiment.
Figure 14A:
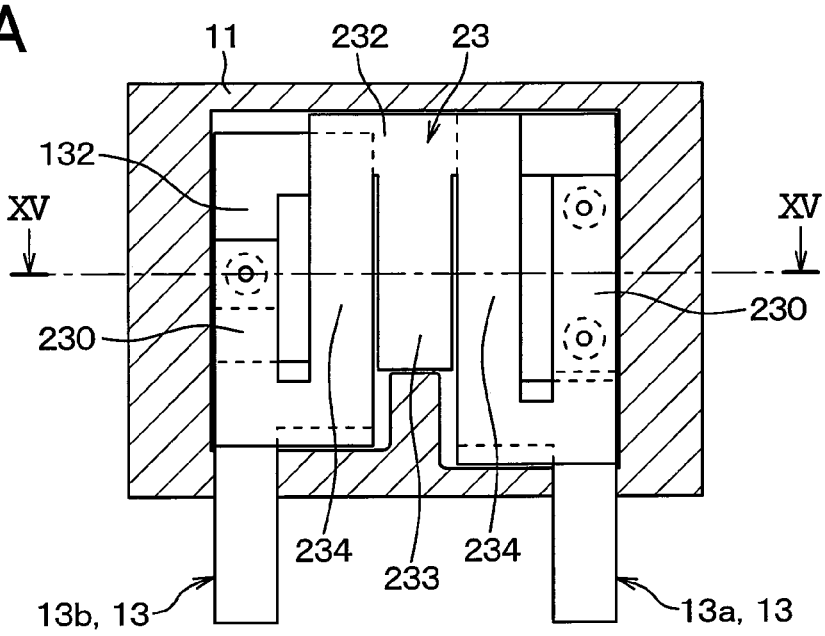
FIG. 14A is a plan cross-sectional view showing a movable element, stators, and a base according to a third modification of the fifth embodiment.
Figure 14B:
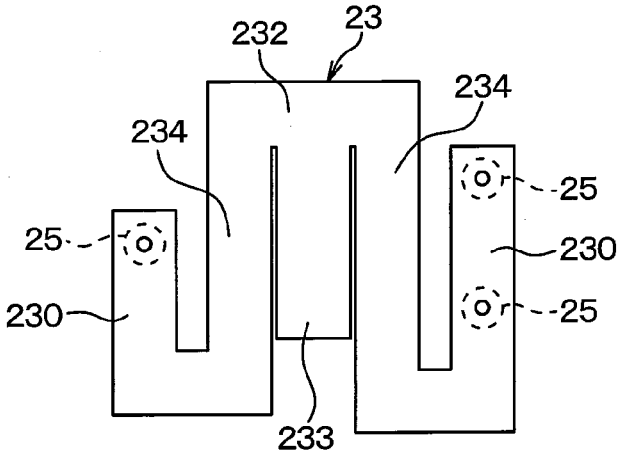
FIG. 14B is a plan view of the movable element in FIG. 14A.
Figure 14C:
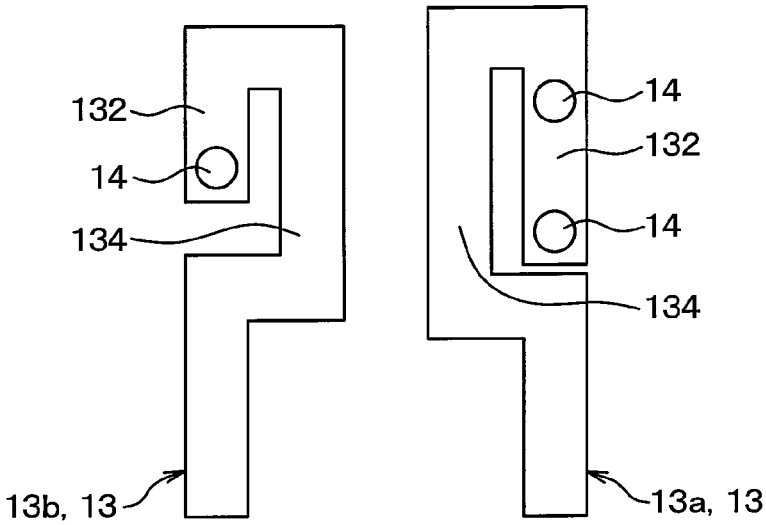
FIG. 14C is a plan view of the stators in FIG. 14A.
Figure 15:
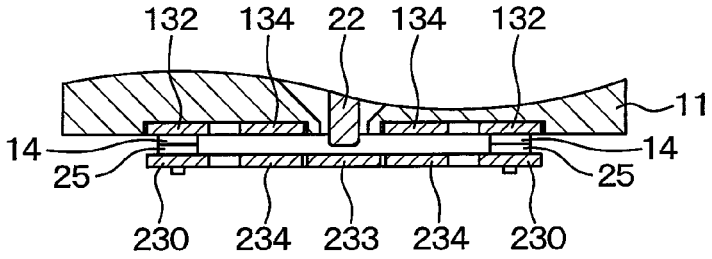
FIG. 15 is a cross-sectional view of the movable element, the stators, and the base taken along a line XV-XV in FIG. 14A.

Further, as in a second modification of the fifth embodiment shown in FIG. 13, the permanent magnet 26 for extending the arc generated when the movable contacts 25 move away from the fixed contacts 14 may be provided outside of the movable contact mounting plates 230 in the movable contact alignment direction.

In this case, the Lorentz, which acts on the movable element 23 by the current flowing in the movable element 23 and the magnetic flux of the permanent magnet 26, becomes smaller than that in the first modification of the fifth embodiment. Therefore, the Lorentz force does not always need to be obtained. As a result, the direction of the magnetic flux of the permanent magnet 26 can be freely set regardless of the direction of the current flowing in the movable element 23.

Also, because the fixed contacts 14 and the movable contacts 25 are disposed outermost in the movable contact alignment direction, an arc blocking space is easily to be ensured.

Furthermore, as in a third modification of the fifth embodiment shown in FIG. 14A to FIG. 14C and FIG. 15, three fixed contacts 14 and three movable contacts 25 may be provided, and the fixed contacts 14 and the movable contacts 25 may be arranged so that a line connecting the three fixed contacts 14 and a line connecting the three movable contacts 25 each form a triangle when viewed along the movable element moving direction. According to this configuration, because three contact contacted portions are provided, the movable element 23 is restricted from vibrating, and furthermore the malfunction caused by vibration of the movable element 23 can be restricted.

Sixth Embodiment

A sixth embodiment of the present disclosure will be described. FIG. 16A is a plan view showing a movable element 23 and stators 13 in a relay according to the sixth embodiment of the present disclosure, FIG. 16B is a front view of the movable element 23 and the stators 13 in FIG. 16A, and FIG. 16C is a cross-sectional view of the movable element 23 and the stators 13 taken along a line XVIC-XVIC in FIG. 16A.

In the present embodiment, the movable element 23 is downsized, and only portions different from those in the first embodiment will be described.

Figure 16C:
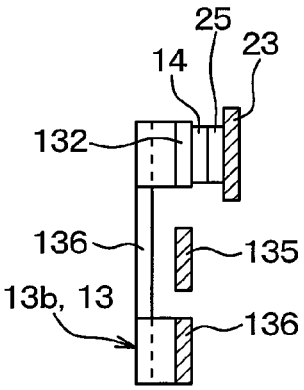
FIG. 16C is a cross-sectional view of the movable element and the stators taken along a line XVIC-XVIC in FIG. 16A.
Figure 16A:
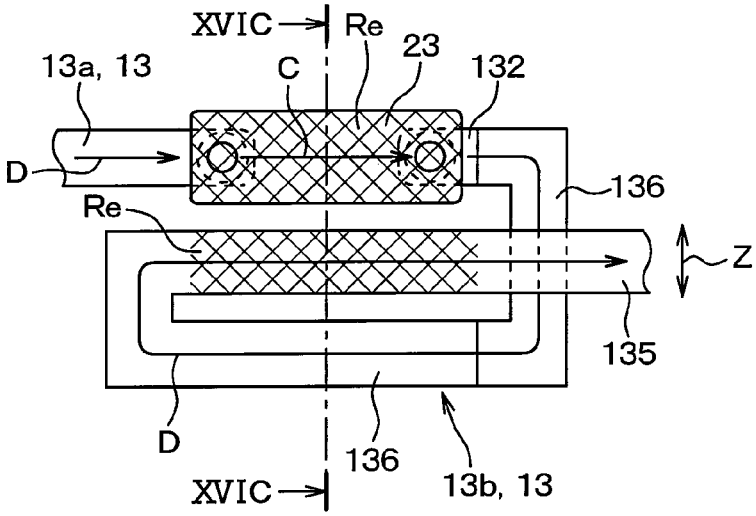
FIG. 16A is a plan view showing a movable element and stators in a relay according to a sixth embodiment of the present disclosure.
Figure 16B:
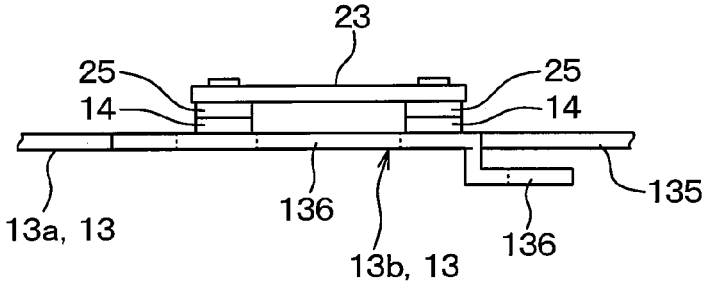
FIG. 16B is a front view of the movable element and the stators in FIG. 16A.

As shown in FIG. 16A to FIG. 16C, the movable element 23 is formed in a slender rectangular parallelepiped shape extending in the movable contact alignment direction, and the whole area of the movable element 23 corresponds to the movable element proximity plate portion.

The second stator 13*b* includes a stator parallel plate 135 that is disposed adjacent to the movable element 23 and extends in parallel to the movable element 23 (that is, movable contact alignment direction). The stator parallel plate 135 and the fixed contact mounting plates 132 are coupled to each other by a bent stator coupling plate 136.

The stator parallel plate 135 and the movable element 23 are arranged in a positional relationship so as to be displaced from each other in the reference direction Z, and so as not to overlap with each other when viewed along the movable element moving direction. Also, the stator parallel plate 135 and the movable element 23 are displaced from each other in the movable element moving direction. In more detail, the stator parallel plate 135 is located on the fixed contact mounting plate 132 side of the movable element 23 when viewed in the movable contact alignment direction as shown in FIG. 16C.

The whole area of movable element 23 is disposed adjacent to a part of the stator parallel plate 135, and hereinafter the adjacent regions are called "proximity regions Re." In FIG. 16A, the proximity regions Re are indicated by mesh designs for descriptive purposes.

In the proximity regions Re, the shape of the second stator 13*b* is set so that a direction of current flowing in the movable element 23 is the same as a direction of current flowing in the stator parallel plate 135. More specifically, the stator coupling plate 136 is bent at a plurality of portions when viewed along the movable element moving direction. Accordingly, a direction of current flowing in the second stator 13*b* is changed so that the direction of current flowing in the stator parallel plate 135 is the same as the direction of current flowing in the movable element 23.

A region of the stator parallel plate 135 which is disposed adjacent to the movable element 23, that is, the proximity region Re of the stator parallel plate 135 corresponds to the stator proximity plate portion.

In the present embodiment, the direction of current flowing in the movable element 23 is the same as the direction of current flowing in the stators 13 in the proximity region Re. As a result, even in the proximity region Re, the attraction that is the Lorentz force is generated between the movable element 23 and the stator parallel plate 135. Hereinafter, the attraction in the proximity regions Re is called "inter-plate attraction Re."

The movable element 23 is biased toward a direction of bringing the movable contacts 25 into contact with the fixed contacts 14 due to a force component of the inter-plate attraction Re. Accordingly, separation between the movable contacts 25 and the fixed contacts 14 due to the contact portion electromagnetic repulsive force can be further restricted.

Also, according to the present embodiment, the movable element 23 can be downsized, and the movable element 23 is smoothly driven to reduce an operating sound.

Seventh Embodiment

Figure 17C:
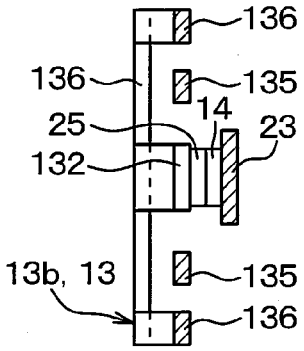
FIG. 17C is a cross-sectional view of the movable element and the stators taken along a line XVIIC-XVIIC in FIG. 17A.
Figure 17A:
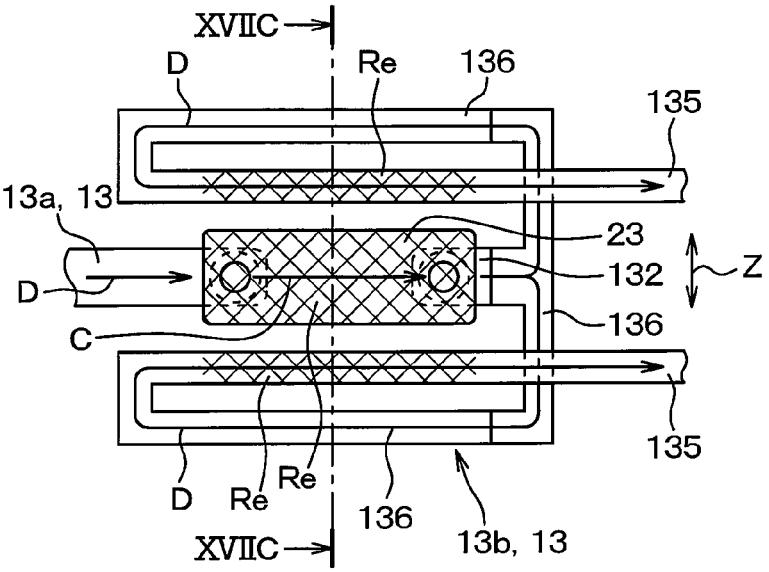
FIG. 17A is a plan view showing a movable element and stators in a relay according to a seventh embodiment of the present disclosure.
Figure 17B:
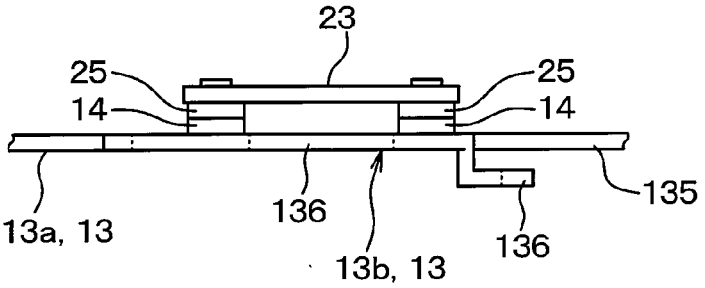
FIG. 17B is a front view of the movable element and the stators in FIG. 17A.

A seventh embodiment of the present disclosure will be described. FIG. 17A is a plan view showing a movable element 23 and stators 13 in a relay according to the seventh embodiment of the present disclosure, FIG. 17B is a front view of the movable element 23 and the stators 13 in FIG. 17A, and FIG. 17C is a cross-sectional view of the movable element 23 and the stators 13 taken along a line XVIIC-XVIIC in FIG. 17A. Hereinafter, only portions different from those in the sixth embodiment will be described.

As shown in FIG. 17A to FIG. 17C, the second stator 13*b* is divided into two pieces from one end of the fixed contact mounting plate 132, and includes two stator parallel plates 135, and two stator coupling plates 136.

The stator parallel plates 135 are disposed adjacent to the movable element 23 so as to sandwich the movable element 23 therebetween and extend in parallel to the movable element 23 (that is, movable contact alignment direction).

In the present embodiment, the inter-plate attractions Re that are the attractions of the proximity regions Re are generated on one side of the contact contacted portions in the reference direction Z, and also on the other side of the contact contacted portions in the reference direction Z. As a result, the posture of the movable element 23 becomes stabilized.

Also, according to the present embodiment, the movable element 23 can be downsized, and the movable element 23 is smoothly driven to reduce an operating sound.

The movable element 23 is biased toward a direction of bringing the movable contacts 25 against the fixed contacts 14 due to a force component of the inter-plate attraction Re. Accordingly, separation between the movable contacts 25 and the fixed contacts 14 due to the contact portion electromagnetic repulsive force can be further restricted.

Also, according to the present embodiment, the current flowing in the second stator 13*b* is divided into two currents by the respective stator parallel plates 135 and the respective stator coupling plates 136. As a result, cross-sectional areas of the respective stator parallel plates 135 and the respective stator coupling plates 136 can be reduced, thereby facilitating a bending process in manufacturing the second stator 13*b*.

Eighth Embodiment

An eighth embodiment of the present disclosure will be described. FIG. 18A is a plan view showing a movable element 23 and a stators 13 in a relay according to the eighth embodiment of the present disclosure, FIG. 18B is a front view of the movable element 23 and the stators 13 in FIG.

Figure 18C:
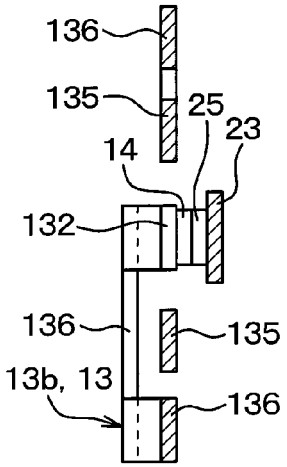
FIG. 18C is a cross-sectional view of the movable element and the stators taken along a line XVIIIC-XVIIIC in FIG. 18A.
Figure 18A:
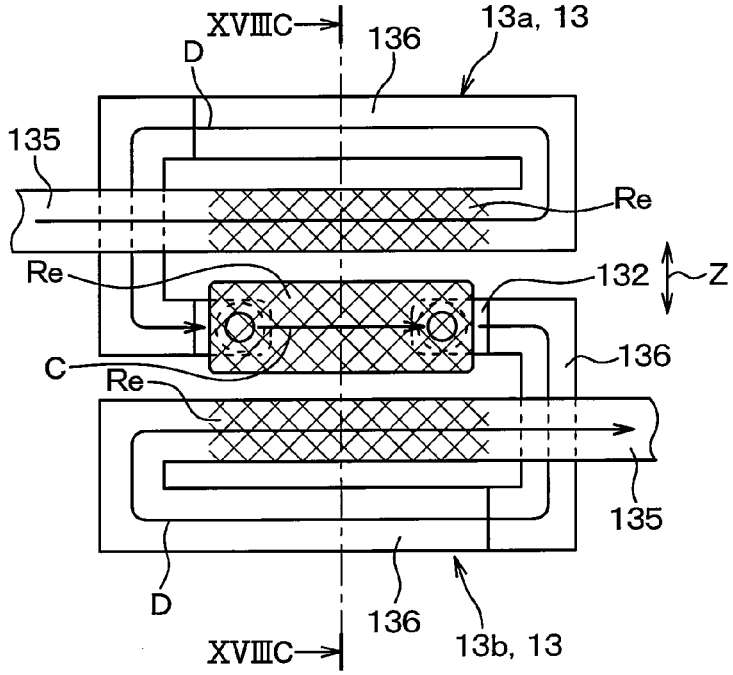
FIG. 18A is a plan view showing a movable element and stators in a relay according to an eighth embodiment of the present disclosure.

18A, and FIG. 18C is a cross-sectional view of the movable element 23 and the stators 13 taken along a line XVIIIC-XVIIIC in FIG. 18A. Hereinafter, only portions different from those in the sixth embodiment will be described.

Figure 18B:
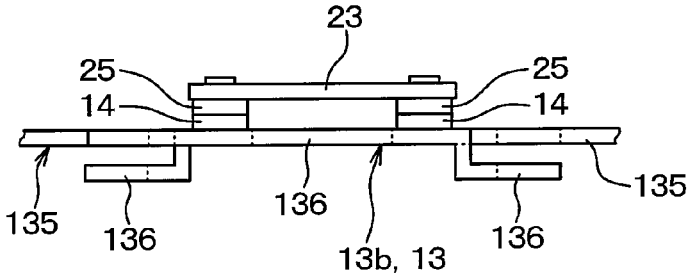
FIG. 18B is a front view of the movable element and the stators in FIG. 18A.

As shown in FIG. 18A to FIG. 18C, the first stator 13*a* also has the same shape as that of the second stator 13*b*. That is, the first stator 13*a* includes the stator parallel plate 135 that is disposed adjacent to the movable element 23 and extends in parallel to the movable element 23 (that is, movable contact alignment direction). The stator parallel plate 135 and the fixed contact mounting plates 132 are coupled to each other by the bent stator coupling plate 136.

The stator parallel plate 135 of the first stator 13*a* and the movable element 23 are arranged in a positional relationship so as to be displaced from each other in the reference direction Z, and so as not to overlap with each other when viewed along the movable element moving direction. Also, the stator parallel plate 135 of the first stator 13*a* and the movable element 23 are displaced from each other in the movable element moving direction. In more detail, the stator parallel plate 135 is located on the fixed contact mounting plate 132 side of the movable element 23 when viewed in the movable contact alignment direction as shown in FIG. 18C.

The whole area of the movable element 23 is disposed adjacent to a part of the stator parallel plate 135 of the first stator 13*a*. In FIG. 18A, the proximity regions Re are indicated by mesh designs for descriptive purposes.

In the proximity regions Re, the shape of the first stator 13*a* is set so that a direction of current flowing in the movable element 23 is the same as a direction of current flowing in the stator parallel plate 135 of the first stator 13*a*. More specifically, the stator coupling plate 136 of the first stator 13*a* is bent at a plurality of portions when viewed along the movable element moving direction. Accordingly, a direction of current flowing in the first stator 13*a* is changed so that the direction of current flowing in the stator parallel plate 135 of the first stator 13*a* is the same as the direction of current flowing in the movable element 23.

In the present embodiment, the current flowing in the respective stator parallel plates 135 becomes twice as large as that in the seventh embodiment, and therefore the total inter-plate attraction Re becomes also twice as large as that in the seventh embodiment. Thus, separation between the movable contacts 25 and the fixed contacts 14 due to the contact portion electromagnetic repulsive force can be further restricted.

Ninth Embodiment

Figure 19:
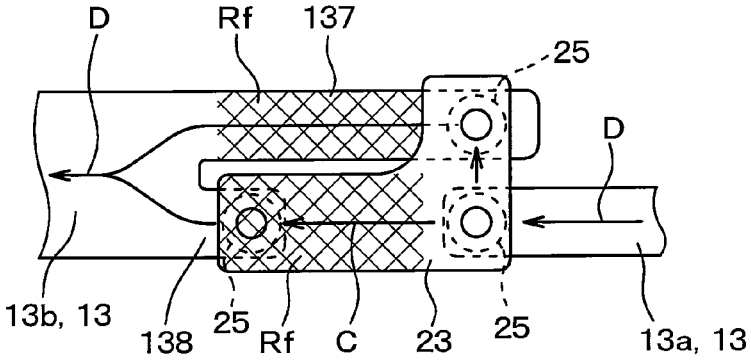
FIG. 19 is a plan view showing a movable element and stators in a relay according to a ninth embodiment of the present disclosure.

A ninth embodiment of the present disclosure will be described. FIG. 19 is a plan view showing a movable element 23 and stators 13 in a relay according to the ninth embodiment of the present disclosure. Hereinafter, only portions different from those in the first embodiment will be described.

As shown in FIG. 19, the movable element 23 is L-shaped when viewed along the movable element moving direction. The movable element 23 has three movable contacts 25, and the movable contacts 25 are arranged so that a line connecting the three movable contacts 25 forms a triangle when viewed along the movable element moving direction.

The first stator 13*a* has one fixed contact (not shown) at a position facing one movable contact 25.

The second stator 13*b* is divided into two pieces, and has a first branched plate 137 and a second branched plate 138 which are different in length from each other. The respective branched plates 137 and 138 are provided with the fixed contacts (not shown) at positions facing the movable contacts 25.

The first branched plate 137 is disposed adjacent to the movable element 23 and extends in parallel to the movable element 23. The adjacent regions are called "proximity regions Rf." In FIG. 19, the proximity regions Rf are indicated by mesh designs for descriptive purposes.

In the proximity regions Rf, the shapes and arrangements of the stators 13 and the movable element 23 are set so that a direction of current flowing in the movable element 23 is the same as a direction of current flowing in the first branched plate 137.

The region of the movable element 23 configuring the proximity regions Rf corresponds to the movable element proximity plate portion. Also, the region of the stators 13 configuring the proximity regions Rf, that is, the first branched plate 137 corresponds to the stator proximity plate portion.

In the present embodiment, in the proximity region Rf, the attraction that is the Lorentz force is generated between the movable element 23 and the first branched plate 137. Hereinafter, the attraction in the proximity regions Rf is called "inter-plate attraction Rf."

The movable element 23 is biased toward a direction for bringing the movable contacts 25 into contact with the fixed contacts 14 due to a force component of the inter-plate attraction Rf. Accordingly, separation between the movable contacts 25 and the fixed contacts 14 due to the contact portion electromagnetic repulsive force can be further restricted.

According to the present embodiment, since the movable element 23 and the stators 13 can be simplified in shape, the costs of the components of the movable element 23 and the stators 13 can be reduced.

Further, because three contact contacted portions are provided, the movable element 23 is restricted from vibrating, and furthermore the malfunction caused by vibration of the movable element 23 can be restricted.

Tenth Embodiment

Figure 20:
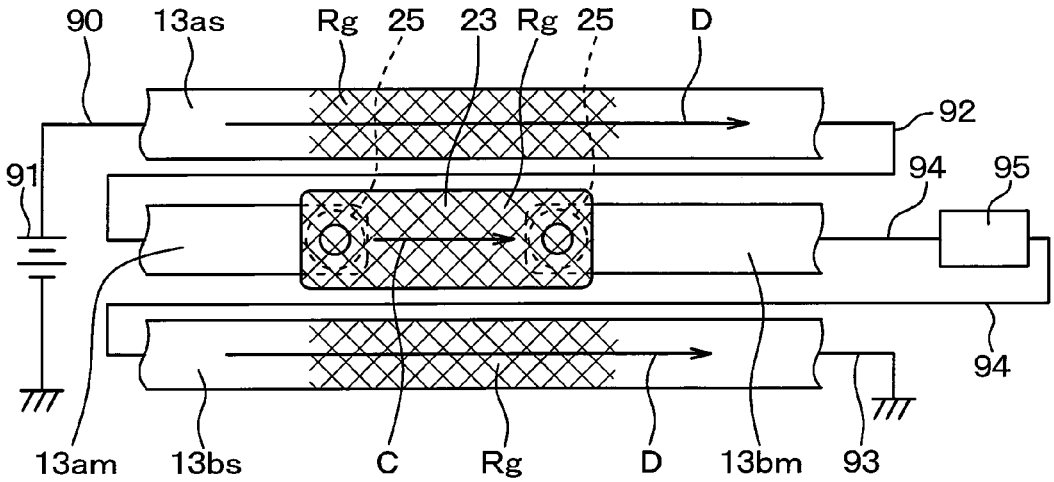
FIG. 20 is a diagram showing configurations of a movable element and stators in a relay, and an external electric circuit according to a tenth embodiment of the present disclosure.

A tenth embodiment of the present disclosure will be described. FIG. 20 is a diagram showing configurations of a movable element 23 and stators 13 in a relay, and an external electric circuit according to the tenth embodiment of the present disclosure. Hereinafter, only portions different from those in the first embodiment will be described.

As shown in FIG. 20, the movable element 23 is formed in a slender rectangular parallelepiped shape extending in the movable contact alignment direction, and the whole area of the movable element 23 corresponds to the movable element proximity plate portion.

The first stator 13*a* is divided into a first main stator 13*am* and a first sub-stator 13*as*. The first main stator 13*am* has a slender a rectangular parallelepiped shape and has a fixed contact (not shown) at a position facing the movable contact 25. The first sub-stator 13*as* has a slender rectangular parallelepiped shape and is coupled to a power supply 91 through an external harness 90. The first main stator 13*am* and the first sub-stator 13*as* are electrically coupled to each other by an external harness 92.

The second stator 13*b* is divided into a second main stator 13*bm* and a second sub-stator 13*bs*. The second main stator 13*bm* has a slender rectangular parallelepiped shape and has a fixed contact (not shown) at a position facing the movable contacts 25. The second sub-stator 13*bs* has a slender rectangular parallelepiped shape and is grounded through an external harness 93.

The second main stator 13*bm* and the second sub-stator 13*bs* are electrically coupled to each other by an external harness 94. Also, an electric load 95 is arranged in the external harness 94.

The first sub-stator 13*as* and the second sub-stator 13*bs* are disposed adjacent to the movable element 23, and extend in parallel to the movable element 23 (that is, movable contact alignment direction).

The whole area of the movable element 23 is disposed adjacent to parts of the first sub-stator 13*as* and the second sub-stator 13*bs*. In FIG. 20, the proximity regions Rg are indicated by mesh designs for descriptive purposes.

In the proximity regions Rg, the arrangements of the movable element 23, the first main stator 13*am*, the first sub-stator 13*as*, the second main stator 13*bm*, and the second sub-stator 13*bs* are set so that a direction of current flowing in the movable element 23 is the same as a direction of current flowing in the first sub-stator 13*as* and the second sub-stator 13*bs*.

Regions of the first sub-stator 13*as* and the second sub-stator 13*bs* disposed adjacent to the movable element 23, that is, the proximity regions Rg of the first sub-stator 13*as* and the second sub-stator 13*bs* correspond to the stator proximity plate portions.

In the present embodiment, the direction of current flowing in the movable element 23 is the same as the direction of current flowing in the first sub-stator 13*as* and the second sub-stator 13*bs* in the proximity regions Rg. As a result, even in the proximity regions Rg, the attraction that is the Lorentz force is generated between the movable element 23 and each of the first sub-stator 13*as* and the second sub-stator 13*bs*. Hereinafter, the attraction in the proximity regions Rg is called "inter-plate attraction Rg."

The movable element 23 is biased toward a direction of bringing the movable contacts 25 into contact with the fixed contacts 14 due to a force component of the inter-plate attraction Rg. Accordingly, separation between the movable contacts 25 and the fixed contacts 14 due to the contact portion electromagnetic repulsive force can be further restricted.

According to the present embodiment, the movable element 23 can be downsized, and the movable element 23 is smoothly driven to reduce an operating sound.

Further, because the movable element 23, the first main stator 13*am*, the first sub-stator 13*as*, the second main stator 13*bm*, and the second sub-stator 13*bs* can be simply shaped, the costs of the components of those stators can be reduced.

Eleventh Embodiment

Figure 21A:
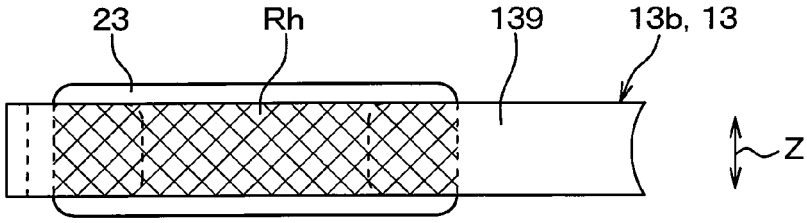
FIG. 21A is a plan view showing a movable element and stators in a relay according to an eleventh embodiment of the present disclosure.
Figure 21B:
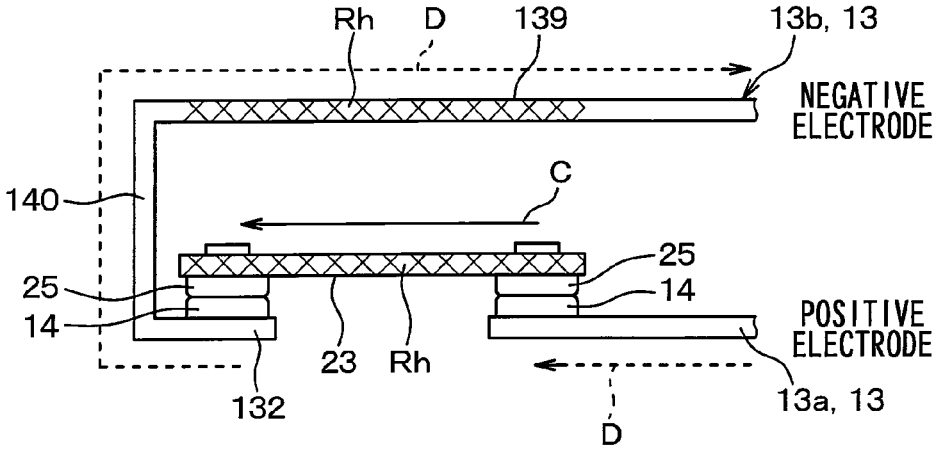
FIG. 21B is a front view of the movable element and the stators in FIG. 21A.

An eleventh embodiment of the present disclosure will be described. FIG. 21A is a plan view showing a movable element 23 and stators 13 in a relay according to the eleventh embodiment of the present disclosure, and FIG. 21B is a front view of the movable element 23 and the stators 13 in FIG. 21A. Hereinafter, only portions different from those in the first embodiment will be described.

As shown in FIG. 21A and FIG. 21B, the movable element 23 is formed in a slender rectangular parallelepiped shape extending in the movable contact alignment direction, and the whole area of the movable element 23 corresponds to the movable element proximity plate portion.

The second stator 13*b* includes a stator parallel plate 139 that is disposed adjacent to the movable element 23 and extends in parallel to the movable element 23 (that is, movable contact alignment direction). The stator parallel plate 139 and the fixed contact mounting plates 132 are coupled to each other by a stator coupling plate 140.

The stator parallel plate 139 faces a surface of the movable element 23 opposite from the fixed contact mounting plates 132. Also, when viewed along the movable element moving direction, a part of the stator parallel plate 139 overlaps with the movable element 23, and the overlap portions are disposed adjacent to each other. The adjacent regions are called "proximity regions Rh." In FIG. 21A and FIG. 21B, the proximity regions Rh are indicated by mesh designs for descriptive purposes.

In the proximity regions Rh, the shape of the second stator 13*b* is set so that a direction of current flowing in the movable element 23 is opposite to a direction of current flowing in the stator parallel plate 139. As shown in FIG. 21B, a boundary between the fixed contact mounting plate 132 and the stator coupling plate 140 is bent at 90 degrees, and a boundary between the stator parallel plate 139 and the stator coupling plate 140 is bent at 90 degrees. With this configuration, a direction of current flowing in the second stator 13*b* is changed so that the direction of current flowing in the stator parallel plate 139 is opposite to the direction of current flowing in the movable element 23.

The proximity region Rh of the stator parallel plate 139 corresponds to the stator proximity plate portion.

In the present embodiment, the direction of current flowing in the movable element 23 is opposite to the direction of current flowing in the stator parallel plate 139 in the proximity regions Rh. Therefore, a force acting in a direction from moving the movable element 23 away from the stator parallel plate 139 is generated in the proximity regions Rh. In other words, in the proximity regions Rh, the repulsive force that is the Lorentz force is generated between the movable element 23 and the stator parallel plate 139. Hereinafter, the repulsive force in the proximity regions Rh is called "inter-plate repulsive force Rh."

The movable element 23 is biased toward a direction for bringing the movable contacts 25 into contact with the fixed contacts 14 due to the inter-plate repulsive force Rh. Accordingly, separation between the movable contacts 25 and the fixed contacts 14 due to the contact portion electromagnetic repulsive force can be restricted.

Because the inter-plate repulsive force Rh is proportional to the square of the current value, separation between the movable contacts 25 and the fixed contacts 14 due to the contact portion electromagnetic repulsive force can be restricted with certainty even during a large-current energization.

Twelfth Embodiment

Figure 22:
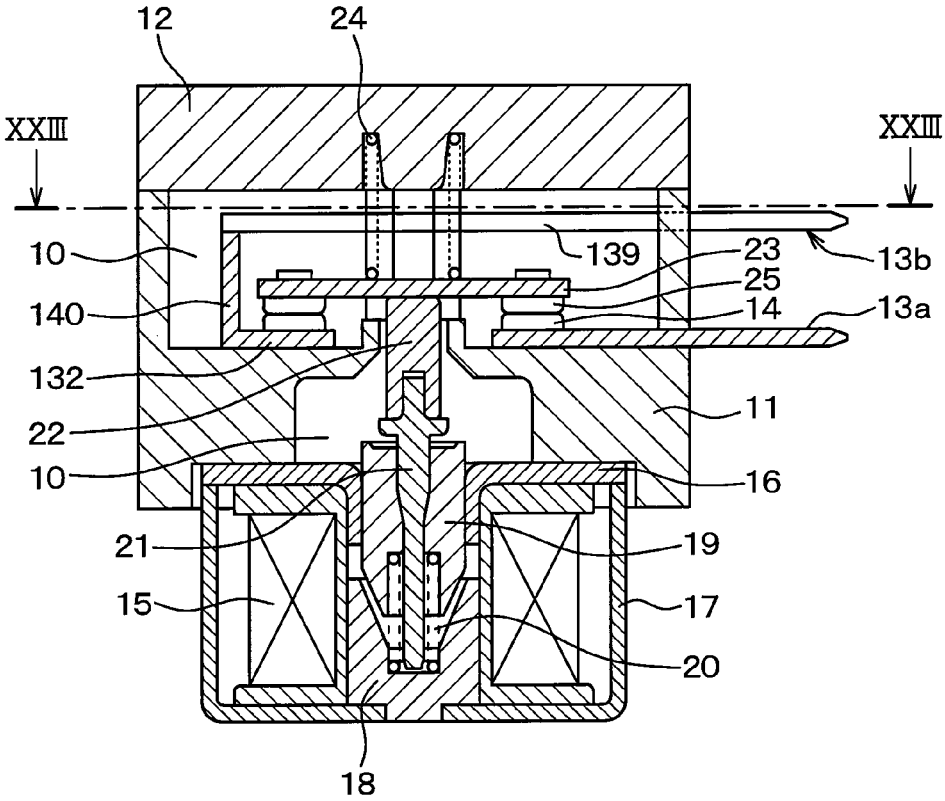
FIG. 22 is a cross-sectional view showing a relay according to a twelfth embodiment of the present disclosure.
Figure 23:
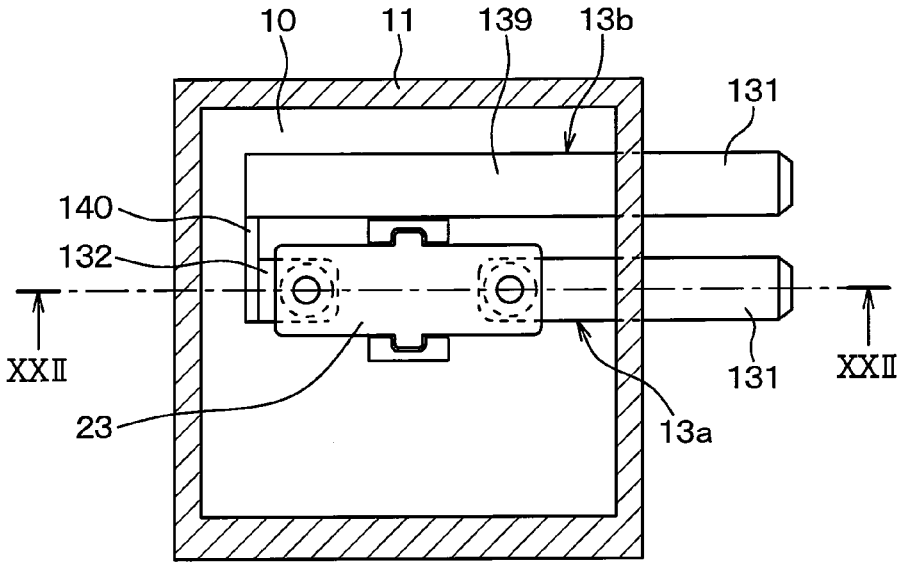
FIG. 23 is a cross-sectional view of the relay taken along a line XXIII-XXIII in FIG. 22.
Figure 24A:
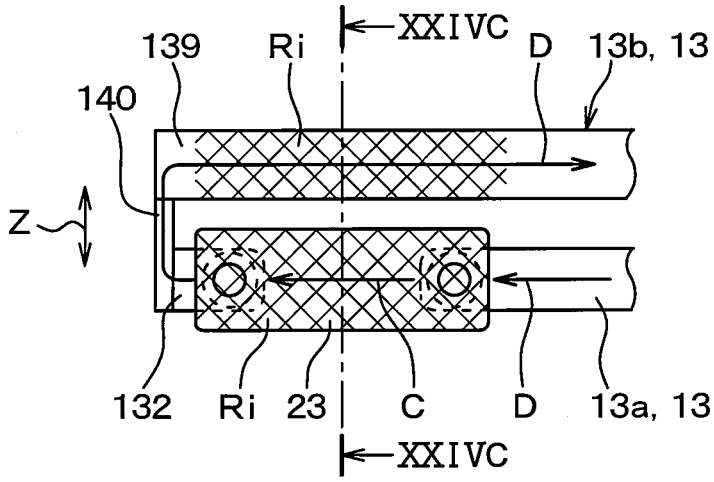
FIG. 24A is a plan view showing the movable element and the stators in the relay in FIG. 22.
Figure 24C:
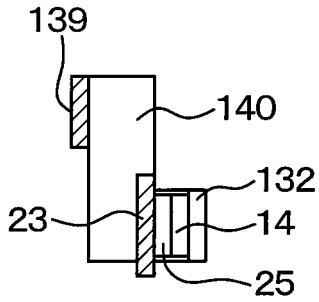
FIG. 24C is a cross-sectional view of the movable element and the stators taken along a line XXIVC-XXIVC in FIG. 24A.
Figure 24B:
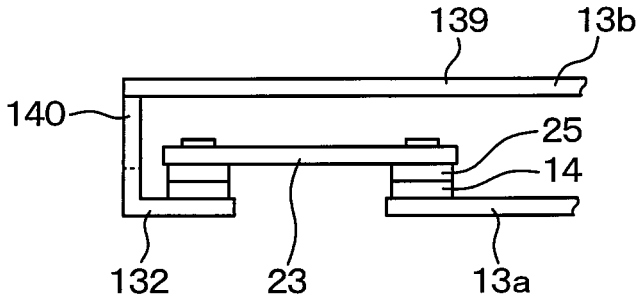
FIG. 24B is a front view of the movable element and the stators in FIG. 24A.

A twelfth embodiment of the present disclosure will be described. FIG. 22 is a cross-sectional view showing a relay according to the twelfth embodiment of the present disclosure, which corresponds to a cross-sectional view taken along a line XXII-XXII in FIG. 23. FIG. 23 is a cross-sectional view of the relay taken along a line XXIII-XXIII in FIG. 22. FIG. 24A is a plan view showing the movable element 23 and the stators 13 in the relay in FIG. 22, FIG. 24B is a front view of the movable element 23 and the stators 13 in FIG. 24A, and FIG. 24C is a cross-sectional view taken along a line XXIVC-XXIVC in FIG. 24A. Hereinafter, only portions different from those in the eleventh embodiment will be described.

As shown in FIG. 22 to FIG. 24C, the second stator 13*b* includes the stator parallel plate 139 that is disposed adjacent to the movable element 23, and extends in parallel to the movable element 23 (that is, movable contact alignment direction). The stator parallel plate 139 and the fixed contact mounting plate 132 are coupled to each other by the stator coupling plate 140.

The stator parallel plate 139 and the movable element 23 are arranged in a positional relationship so as to be displaced from each other in the reference direction Z, and so as not to overlap with each other when viewed along the movable element moving direction. Also, the stator parallel plate 139 and the movable element 23 are displaced from each other in the movable element moving direction. In more detail, the stator parallel plate 139 is located on a side of the movable element 23 opposite from the fixed contact mounting plate 132 when viewed along the movable contact alignment direction as in FIG. 24C.

The whole area of the movable element 23 is disposed adjacent to a part of the stator parallel plate 139, and hereinafter the adjacent regions are called "proximity regions Ri." In FIG. 24A, the proximity regions Ri are indicated by mesh designs for descriptive purposes.

In the proximity regions Ri, the shape of the second stator 13*b* is set so that the direction of current flowing in the movable element 23 is opposite to the direction of current flowing in the stator parallel plate 139. As shown in FIG. 24B, a boundary between the fixed contact mounting plate 132 and the stator coupling plate 140 is bent at 90 degrees, and a boundary between the stator parallel plate 139 and the stator coupling plate 140 is bent at 90 degrees. With this configuration, a direction of current flowing in the second stator 13*b* is changed so that the direction of current flowing in the stator parallel plate 139 is opposite to the direction of current flowing in the movable element 23.

A region of the stator parallel plate 139, which is disposed adjacent to the movable element 23, that is, the proximity region Ri of the stator parallel plate 139 corresponds to the stator proximity plate portion.

In the present embodiment, the direction of current flowing in the movable element 23 is opposite to the direction of current flowing in the stator parallel plate 139 in the proximity regions Ri. Therefore, a force acting in a direction for moving the movable element 23 away from the stator parallel plate 139 is generated in the proximity regions Ri. In other words, in the proximity regions Ri, the repulsive force that is the Lorentz force is generated between the movable element 23 and the stator parallel plate 139. Hereinafter, the repulsive force in the proximity regions Ri is called "inter-plate repulsive force Ri."

The movable element 23 is biased toward a direction for bringing the movable contacts 25 into contact with the fixed contacts 14 due to a force component of the inter-plate repulsive force Ri. Accordingly, separation between the movable contacts 25 and the fixed contacts 14 due to the contact portion electromagnetic repulsive force can be restricted.

Also, the stator parallel plate 139 and the movable element 23 are arranged so as not to overlap with each other when viewed along the movable element moving direction. Therefore, a space is formed on a side of the movable element 23 opposite to the fixed contact mounting plate, and the contact pressure spring 24 can be arranged in the space.

Thirteenth Embodiment

Figure 25A:
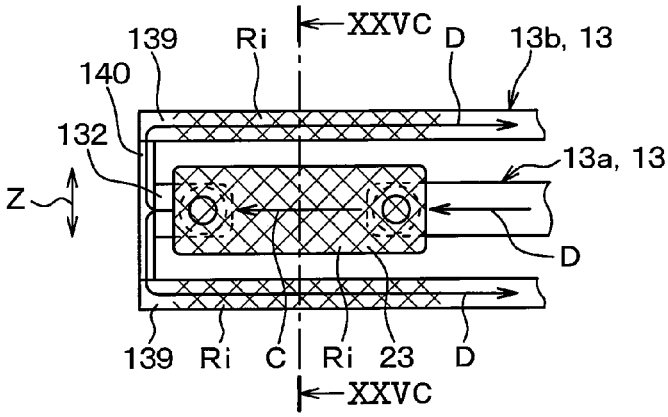
FIG. 25A is a plan view showing a movable element and stators in a relay according to a thirteenth embodiment of the present disclosure.
Figure 25C:
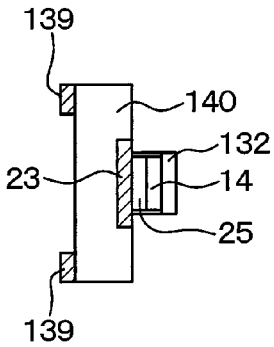
FIG. 25C is a cross-sectional view of the movable element and the stators taken along a line XXVC-XXVC in FIG. 25A.
Figure 25B:
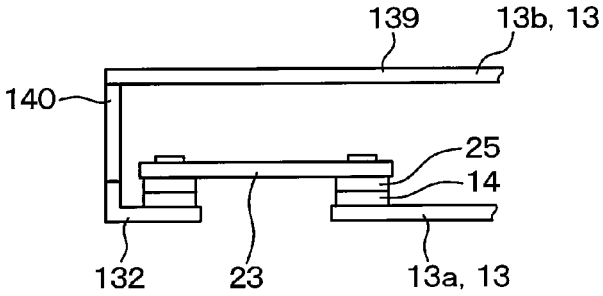
FIG. 25B is a front view of the movable element and the stators in FIG. 25A.

A thirteenth embodiment of the present disclosure will be described. FIG. 25A is a plan view showing a movable element 23 and stators 13 in a relay according to the thirteenth embodiment of the present disclosure, FIG. 25B is a front view of the movable element 23 and the stators 13 in FIG. 25A, and FIG. 25C is a cross-sectional view taken along a line XXVC-XXVC in FIG. 25A. Hereinafter, only portions different from those in the twelfth embodiment will be described.

As shown in FIG. 25A to FIG. 25C, the second stator 13*b* is branched into two pieces from one end of each fixed contact mounting plate 132, and includes two stator parallel plates 139 and two stator coupling plates 140.

The two stator parallel plates 139 are disposed adjacent to the movable element 23 so as to sandwich the movable element 23 therebetween and extend in parallel to the movable element 23 (that is, movable contact alignment direction).

In the present embodiment, the inter-plate repulsive force Ri that is the repulsive force of the proximity region Ri is generated on one side of each of the contact contacted portions in the reference direction Z, and also on the other side of each of the contact contacted portions in the reference direction Z. As a result, the posture of the movable element 23 becomes stabilized.

Furthermore, according to the present embodiment, the current flowing in the second stator 13*b* is divided into two currents by the respective stator parallel plate 139 and the respective stator coupling plates 140. As a result, cross-sectional areas of the respective stator parallel plates 139 and the respective stator coupling plates 140 can be reduced, thereby facilitating a bending process in manufacturing the second stator 13*b*.

Fourteenth Embodiment

Figure 26A:
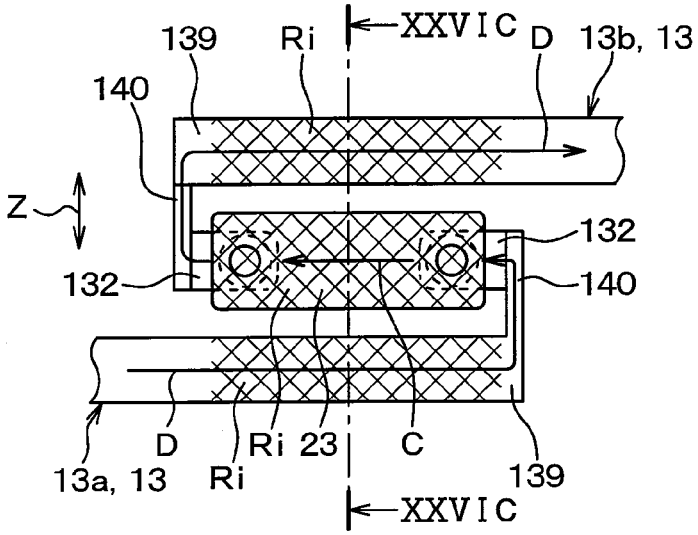
FIG. 26A is a plan view showing a movable element and stators in a relay according to a fourteenth embodiment of the present disclosure.
Figure 26C:
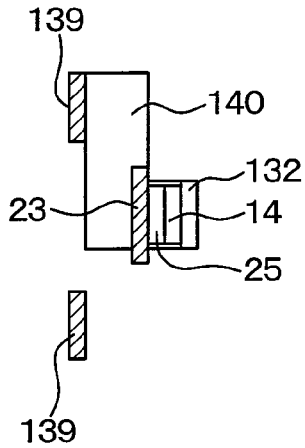
FIG. 26C is a cross-sectional view of the movable element and the stators taken along a line XXVIC-XXVIC in FIG. 26A.
Figure 26B:
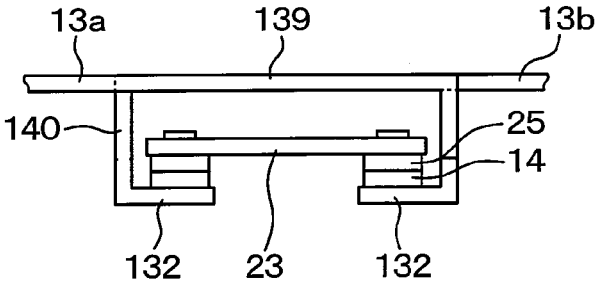
FIG. 26B is a front view of the movable element and the stators in FIG. 26A.

A fourteenth embodiment of the present disclosure will be described. FIG. 26A is a plan view showing a movable element 23 and stators 13 in a relay according to the fourteenth embodiment of the present disclosure, FIG. 26B is a front view of the movable element 23 and the stators 13 in FIG. 26A, and FIG. 26C is a cross-sectional view of the movable element 23 and the stators 13 taken along a line XXVIC-XXVIC in FIG. 26A. Hereinafter, only portions different from those in the twelfth embodiment will be described.

As shown in FIG. 26A to FIG. 26C, the first stator 13*a* also has the same shape as the second stator 13*b*. That is, the first stator 13*a* includes the stator parallel plate 139 that is disposed adjacent to the movable element 23, and extends in parallel to the movable element 23 (that is, movable contact alignment direction). The stator parallel plate 139 and the fixed contact mounting plate 132 are coupled to each other by the stator coupling plate 140.

The stator parallel plate 139 of the first stator 13*a* and the movable element 23 are arranged in a positional relationship so as to be displaced from each other in the reference direction Z, and so as not to overlap with each other when viewed along the movable element moving direction. Also, the stator parallel plate 139 of the first stator 13*a* and the movable element 23 are displaced from each other in the movable element moving direction. In more detail, the stator parallel plate 139 is located on a side of the movable element 23 opposite from the fixed contact mounting plate 132 when viewed along the movable contact alignment direction as shown in FIG. 26C.

The whole area of the movable element 23 is disposed adjacent to a part of the stator parallel plate 139 of the first stator 13*a*. In FIG. 26A, the proximity regions Ri are indicated by mesh designs for descriptive purposes.

In the proximity regions Ri, the shape of the first stator 13*a* is set so that the direction of current flowing in the movable element 23 is opposite to the direction of current flowing in the stator parallel plate 139 of the first stator 13*a*. In more detail, as shown in FIG. 26B, a boundary between the fixed contact mounting plate 132 and the stator coupling plate 140 is bent at 90 degrees, and a boundary between the stator parallel plate 139 and the stator coupling plate 140 is bent at 90 degrees. With this configuration, a direction of current flowing in the first stator 13*a* is changed so that the direction of current flowing in the stator parallel plate 139 is opposite to the direction of current flowing in the movable element 23.

In the present embodiment, the direction of current flowing in the movable element 23 is opposite to the direction of current flowing in the stator parallel plate 139 in the proximity regions Ri. Therefore, a force acting in a direction for moving the movable element 23 away from the stator parallel plate 139 is generated in the proximity regions Ri. In other words, in the proximity regions Ri, the repulsive force that is the Lorentz force is generated between the movable element 23 and the stator parallel plate 139. Hereinafter, the repulsive force in the proximity regions Ri is called "inter-plate repulsive force Ri."

The movable element 23 is biased toward a direction for bringing the movable contacts 25 into contact with the fixed contacts 14 due to a force component of the inter-plate repulsive force Ri. Thus, separation between the movable contacts 25 and the fixed contacts 14 due to the contact portion electromagnetic repulsive force can be restricted.

In the present embodiment, a current flowing in each of the stator parallel plates 139 is twice as large as that in the twelfth embodiment. Therefore, a total inter-plate repulsive force Ri is also twice as large as that in the twelfth embodiment. Thus, separation between the movable contacts 25 and the fixed contacts 14 due to the contact portion electromagnetic repulsive force can be further restricted.

Other Embodiments

In the above respective embodiments, the movable core 19 is attracted toward the fixed core 18 by the electromagnetic force of the coil 15. Alternatively, the movable core 19 may be driven toward the fixed core 18 by driving means other than the coil 15.

Also, in the above respective embodiments, the fixed contacts 14 of different members are fixed by swaging on the respective stators 13. Alternatively, a protrusion may be formed on each of the stators 13, for example, by a press work so as to protrude toward the movable element 23, and the protrusion may function as the fixed contact.

Likewise, in the above respective embodiments, the movable contacts 25 of different members are fixed by swaging on the movable element 23. Alternatively, protrusions may be formed on the movable element 23, for example, by a press work so as to protrude toward the stators 13, and the protrusions may function as the movable contact.

The above respective embodiments can be arbitrarily combined together within a practicable range.

What is claimed is:

1. A relay comprising:

two stators each having a plate shape and each having a fixed contact; and a movable element having a plate shape and having movable contacts, the movable element being movable in a movable element moving direction so that the movable contacts respectively come in contact with the fixed contacts to close an electric circuit and the movable contacts separates from the fixed contacts to open the electric circuit, wherein the movable element includes two movable contact mounting plates on which the movable contacts are fixed, a movable element coupling plate extending in a movable contact alignment direction, and two movable element side plates located inside or outside of the movable contact mounting plates in the movable contact alignment direction, the movable contact mounting plates and the movable element side plates extend in parallel to a reference direction that is perpendicular to the movable element moving direction and the movable contact alignment direction and are coupled to each other on one end side in the reference direction, and the other end sides of the movable element side plates are coupled to the movable element coupling plate, wherein each of the stators includes a fixed contact mounting plate on which the fixed contact is fixed and a stator side plate located inside or outside of the fixed contact mounting plate in the movable contact alignment direction, the fixed contact mounting plates and the stator side plates extend in parallel to the reference direction and are coupled to each other on one end side in the reference direction, wherein each of the stators includes a stator proximity plate portion adjacent to the movable element, and the movable element includes a movable element proximity plate portion adjacent to the stators, wherein a direction of current flowing in the stator proximity plate portions is set to be the same as a direction of current flowing in the movable element proximity plate portion to generate an inter-plate attraction force for attracting the movable element proximity plate portion onto the stator proximity plate portions, and wherein the movable element proximity plate portion is biased by the inter-plate attraction force toward a direction for bringing the movable contacts into contact with the fixed contacts.

2. The relay according to claim 1, wherein the stator proximity plate portions and the movable element proximity plate portion are disposed between the fixed contact of one of the stators and the fixed contact of the other stator.

3. The relay according to claim 1, wherein the movable element has a rectangular parallelepiped shape, and the whole area in the movable element corresponds to the movable element proximity plate portion, and wherein each of the stators is bent between a portion where the fixed contact is mounted and the stator proximity plate portion so that the direction of current flowing in the stator proximity plate portion is same as the direction of current flowing in the movable element proximity plate portion.

4. The relay according to claim 1, further comprising a magnet disposed adjacent to the movable element, wherein a Lorentz force generated by the current flowing in the movable element and a magnetic flux of the magnet acts in a direction for bringing the movable contacts into contact with the fixed contacts.

5. The relay according to claim 1, wherein the two stators include three of the fixed contacts, and the movable element includes three of the movable contacts, and wherein each of a line connecting the three fixed contacts and a line connecting the three movable contacts form a triangle when viewed along a moving direction of the movable element.

6. The relay according to claim 1, further comprising:

a coil generating an electromagnetic force during energization;

a movable member attracted by the electromagnetic force of the coil; and a contact pressure spring biasing the movable element in a direction for bringing the movable contacts into contact with the fixed contacts, wherein when the movable member is attracted by the electromagnetic force of the coil, the movable member moves away from the movable element, and the movable element is biased by the contact pressure spring so that the movable contacts come into contact with the fixed contacts.

7. The relay according to claim 1, wherein the movable element side plates are movable element outside plates located outside of the movable contact mounting plates in the movable contact alignment direction, and wherein the stator side plates are stator outside plates respectively located outside of the fixed contact mounting plates in the movable contact alignment direction.

* * * * *